US006026547A

United States Patent [19]

O'Donnell Kiely

[11] Patent Number: 6,026,547

[45] Date of Patent: Feb. 22, 2000

[54] IMMOBILIZED ALIGNMENT CLOSURE SYSTEM

[76] Inventor: Alice Mary O'Donnell Kiely, 2020 Maple Hill, Yorktown, N.Y. 10598

[21] Appl. No.: 09/220,828

[22] Filed: Dec. 24, 1998

Related U.S. Application Data

[63] Continuation-in-part of application No. 08/856,679, May 15, 1997, abandoned.

[51] Int. Cl.[7] ..... A44B 19/00

[52] U.S. Cl. ..... 24/433; 24/415; 24/434

[58] Field of Search ..... 24/388, 390, 399, 24/400, 587, 576, 433, 434, 435, 436

[56] References Cited

U.S. PATENT DOCUMENTS

| | | | |
|---|---|---|---|
| 3,752,718 | 8/1973 | Potin | 24/434 X |
| 4,139,927 | 2/1979 | Heimberger . | |
| 4,221,026 | 9/1980 | Kanzaka . | |
| 5,007,145 | 4/1991 | Kim . | |
| 5,272,793 | 12/1993 | Wilk . | |
| 5,333,362 | 8/1994 | Gillioz . | |
| 5,396,685 | 3/1995 | Wilk . | |
| 5,400,482 | 3/1995 | Oda . | |
| 5,412,849 | 5/1995 | Fudaki | 24/388 |
| 5,586,370 | 12/1996 | Fudaki | 24/433 |
| 5,608,952 | 3/1997 | Wilder . | |
| 5,653,002 | 8/1997 | Ishihara et al. . | |

OTHER PUBLICATIONS

U.S. Ser. No. 378,362, Kiely, filed 1995, Document Disclosure.

*Primary Examiner*—James R. Brittain
*Assistant Examiner*—Robert J. Sandy

[57] ABSTRACT

A zipper system comprises two elongated coupling elements (38) and (40) each having a row of interlocking elements (42) and (44) mounted on and along their respective inner edges. The zipper provides arresting female members (22Z, 22', 22, 36, 36', 23, 23') including a female arresting slider (22Z, 22', 22) slidably connected to one of two elongated coupling elements (38, 40). The arresting female members (22Z, 22', 22, 36, 36', 23, 23') are adapted to unite with each other (differently in various embodiments) to form a coupled female unit (22F) with a planar surface for coupling and uncoupling with a male interlocking element (26, 26', 32, 34, 26E–26N, 80–90). The zipper also comprises intergarment plates (50, 52) with thumbholds (54, 56), strap holders (94), a two-way zipper (23, 23') and resilient locking assemblies (28, 30). A rigid two piece interlocking buckle (11) attached to the respective inner edges of the two elongated coupling elements provide quick and easy initial snap-lock coupling of the two elongated coupling elements (38, 40) which are coupled and uncoupled along their length by female arresting slider (22Z, 22', 22).

23 Claims, 24 Drawing Sheets

IMMOBILIZED ALIGNMENT CLOSURE SYSTEM

CROSS REFERENCE TO RELATED APPLICATION

This patent is based upon an application which is a continuation-in-part of application Ser. No. 08/856,679, filed May 15, 1997, now abandoned.

BACKGROUND

Zippers are a useful invention and are widely used The everyday zipper is predominantly used by sliding a zipper head, on one fabric piece, down to the top of a socket box. A second pin located on another fabric piece is threaded through the small opening of the zipper head and into the socket box. This positions the second pin next to a first pin permanently affixed inside the socket box. Above each pin, and attached to a woven fabric strip on each fabric piece, are a series of engaging zipper teeth which are designed to intermesh with each other when one pulls up the zipper head.

This process requires precision, relative stillness of a person, good eyesight, eye-hand coordination, and dexterity. A common problem of initial coupling is misalignment of the second pin when it is not pushed all the way down through the sliding zipper head and into the lower socket. Premature separation of the sliding zipper head from the socket box makes coupling difficult. Trying to find the narrow opening for the second pin, aligning the entrances of the sliding zipper head and socket box and threading it at night, or even in the daylight, are difficult and frustrating tasks for many users.

Any and all of us at one time or another, especially persons in a hurry, the elderly, those with arthritis, feebleness, poor or no vision, or persons with disabilities and their care givers almost always have difficulty coupling a zipper. In addition, sportsmen and women, such as skiers, gardeners, or any persons using gloves at recreational activities or their occupations, including firefighters, emergency medical technicians and astronauts, or those who are wearing winter apparel have had difficulty. Very young children who have not mastered the art of fine motor skills find it very difficult to couple a zipper. Pre-school teachers often have to shorten their classes in the winter in order to line up the children and zip their jackets so they stay warm during their ride home.

Quality jackets are often handed down, especially to children. Although a very welcome gesture from thoughtful family and friends, these jackets often present a problem. While the jacket may seem quite new and in very good condition, upon further inspection (usually through attempted use), the jacket cannot be worn or at least for very long because the zipper is worn (usually frayed at the end). If it works at all, coupling the zipper is very frustrating to the child or parent. This is because zippers are not as durable as the garment to which they are attached.

A skilled tailor or seamstress can replace a zipper on an unlined jacket without great difficulty, but they find it is extremely difficult to replace one on a lined winter jacket. During manufacture, the zipper is usually put on before the garment is lined and before it is turned right side out and the waistband put on. What is usually worn and frayed is a slightly stiffened tape or woven fabric on a second coupling strip immediately outside the second pin. This part wears because it is the first thing to come in contact with the hardware, i.e., the zipper head and socket box. Its repeated use causes the stiffened tape or fabric to soften and fray. The breakdown of this small area usually causes an otherwise suitable jacket to have to be permanently discarded.

Designers have addressed the problem of difficulty in the alignment and initial coupling of zippers, especially for children and their lack of fine motor skills, but seemingly has only substituted one difficulty for another.

U.S. Pat. No. 4,139,927 to Heimberger (1979) shows a small circular plug and socket used to make the proper alignment, but this arrangement also needs a fair amount of stillness, keen eyesight, and dexterity to complete its operation. Also U.S. Pat. Nos. 5,272,793 (1993) and 5,396,685 to Wilk (1995) show a small ball-and-socket snap for primary alignment The zippers of these two patents, also, like the everyday zipper in use now, leave the woven fabric edges of the coupling strip unprotected or only slightly so. Thus they are vulnerable to being worn away before the article of manufacture wears out. Also they use a small snap which small children, the feeble, the sight impaired, and those in a hurry will have trouble aligning as well.

In the arrangement of U.S. Pat. No. 4,221,026 to Kanzaka (1980), a small stud pin is inserted into a precise guide channel. This channel also has a very small aperture, requiring good dexterity, eye-hand coordination, and fine motor skills, which the aforementioned may not have. Similarly, U.S. Pat. No. 5,333,362 to Gillioz (1994) shows a slider used in much the same way as the above pin, being guided down into a narrow channel, requiring stillness of hand, good eyesight, and dexterity.

U.S. Pat. No. 5,007,145 to Kim (1991) shows an end-locking device for slide fasteners to free the hands and to prevent unintentional disengagement of the zipper after the zipper is fastened. None of the members of this zipper are integrated for any purpose, nor is arresting the movement of the slider suggested. The slider is not intentionally aligned with the socket member to arrest movement of the slider. This zipper cannot be coupled laterally.

U.S. Pat. No. 5,412,849 to Fudaki (1995) discloses a separable bottom end stop assembly for a concealed slide fastener, "in which a socket member is attached to one stringer after the stringer is sewn to a garment so that the socket member would not interfere with the sewing, . . . Fudaki projection engages the slider body in order to pull up and actively move the socket member into a desired position. Fudaki's projection does not arrest horizontal movement of the slider body but actively moves the socket member. This zipper cannot be coupled laterally.

U.S. Pat. No. 5,608,952 to Wilder (1997) shows a laterally coupled zipper. Wilder's sliding zipper head and the socket member below it are not integrated in any way, making coupling awkward and uneven when coupled laterally, since the sliding zipper head is free to move sideways and upwards during coupling. The bottom of the zipper head is especially free to move from side to side and will not properly and consistently align itself when pushed upon laterally.

Also, a considerable amount of force is needed to snap-lock the end connector, and displace the resilient socket member, since a socket member should be a sturdy part of the zipper to hold the zipper together. This can be difficult for children and the elderly. This amount of force may cause a twist motion and cause the user to have to compensate for a difference in aligning the members along the same plane again, should the nose element hit the entrance off-center or if the nose element should hit the outer edge of the socket member entrance. There is no guiding apparatus for the user to easily find the small entrance of the socket member for initial coupling. The area to be held during coupling is not large enough for little fingers, big fingers, feeble fingers, or those in motion to easily displace the socket member for lateral coupling.

U.S. Pat. No. 5,400,482 to Oda (1995) discloses a terminal latch member for closing the terminal end of a zipper. The terminal latch locks the upper end of the zipper and allows the slider to be slid off the fastener rows leaving the fastener rows locked. A similar U.S. Pat. No. 5,653,002 to Ishihara et al. (1997) discloses a split arrester also attached to the terminal end of the zipper for preventing the accidental splitting a pair of fasteners stringers when the slider is removed beyond the terminal end. These two patents do not teach any methods of integration or have any integrated parts. Their zipper sliders are purposefully removed from the fastener rows, illustrating methods that distinctly contrast the teachings of the following disclosed invention. These two zippers cannot be coupled laterally.

The arrangement of U.S. Pat. No. 5,586,370, also to Fudaki (1996) shows a separable bottom stop assembly that can be added to the opposed stringers after the stringers have been sewn in place on a garment and the slider has been put on, for the purpose of making the attachment of the stringers to the garment easier. This patent does not integrate any members of the zipper, nor is any movement of the members arrested from integration to promote easy coupling. This zipper cannot be coupled laterally.

Potin discloses in U.S. Pat. No. 3,752,718 (1973) a process for the manufacture of a slide fastener where the female piece or housing is manufactured separately and affixed to the supporting tape at a later time. This process does not arrest any movement or provide immovable alignment of a sliding zipper member. This zipper cannot be coupled laterally.

OBJECTS AND ADVANTAGES

Accordingly, several objectives and advantages of my system are:

(a) to provide an easy-to-use zipper for all members of society, including the very young, feeble or infirm persons, and people with little or no vision;

(b) to provide an easy-start-and-lock zipper that does not require keen eyesight, fine motor skills, strength, or dexterity;

(c) to provide a zipper which has an extra amount of convenience economically, since it is installed in areas of garments that already exist, such as along the usual edges and in the waistband;

(d) to provide a quality easy-to-use zipper that can be used on reversible and non-reversible items, that will last longer, and that reduces fraying;

(e) to provide a zipper that lasts virtally as long as its garment, thereby enabling such garments to last longer than those with prior-art zippers;

(f) to provide a zipper that can almost as easily be coupled in the dark, as well as in the light, such as in theaters, cars, and camping;

(g) to provide a zipper that promotes feelings of accomplishment and self-reliance, rather than feelings of frustration and dependence.

Other objects and advantages of my zipper are:

(a) to provide a zipper that arrests the movement of the members of the female side of the zipper system making coupling easier and more reliable;

(b) to provide an easily coupled zipper which can be used by a person wearing gloves as part of their winter attire, sports, or occupations;

(c) to provide an easy-to-use, zipper, where the alignment and coupling of the zipper is provided by the design of the zipper system and not the eyesight of the user;

(d) to provide a zipper with an audible (snap) confirmation that the zipper has been initially coupled, so as to benefit those with sight impairments and to those using the zipper in the dark;

(e) to enhance the appearance of an article of clothing or article of manufacture by supplying it with a simplistic, adornable, attractive zipper;

(f) to provide a zipper that needs a minimum of force, pressure or exertion from the user to couple or uncouple the zipper;

(g) to provide a zipper that is simple enough for children to easily use by themselves, that is both educational in the way of its operation, and is also fun for them to use, while teaching them to be self-sufficient;

(h) to provide a zipper where most users can readily identify how it operates by looking at its appearance, since a coupling apparatus for the integrated, laterally coupled zipper appears and initially works like a two-piece, snap-together laterally coupled, buckle.

Still further objects and advantages of my zipper will become apparent from a consideration of the drawings and ensuing description.

BRIEF DESCRIPTION OF THE DRAWING FIGURES

The following illustrations are not to scale and are provided for the fundamental understanding of the disclosed invention along with its description. The features illustrated in the drawings can be combined for different applications, or other methods can be used.

Figure 19A:
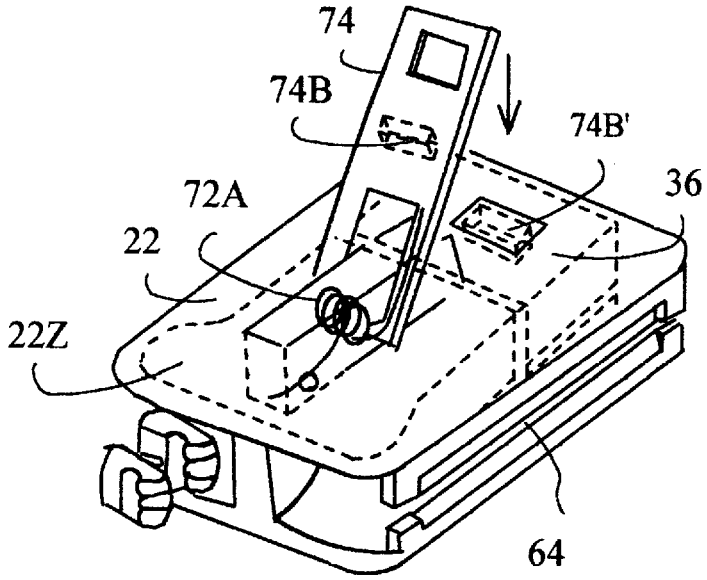
Figure 19B:
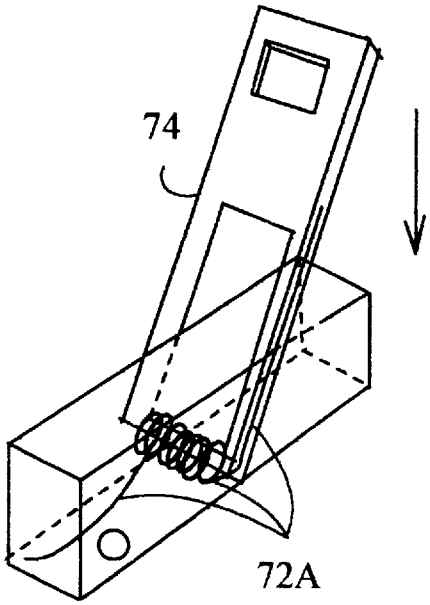
Figure 19C:
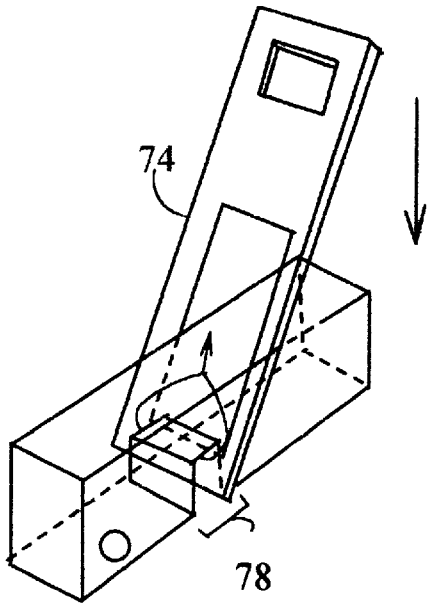

FIGS. 19A–C are perspective views illustrating methods of providing a flat surface to the integrated zipper, according to my invention.

Figure 20A:
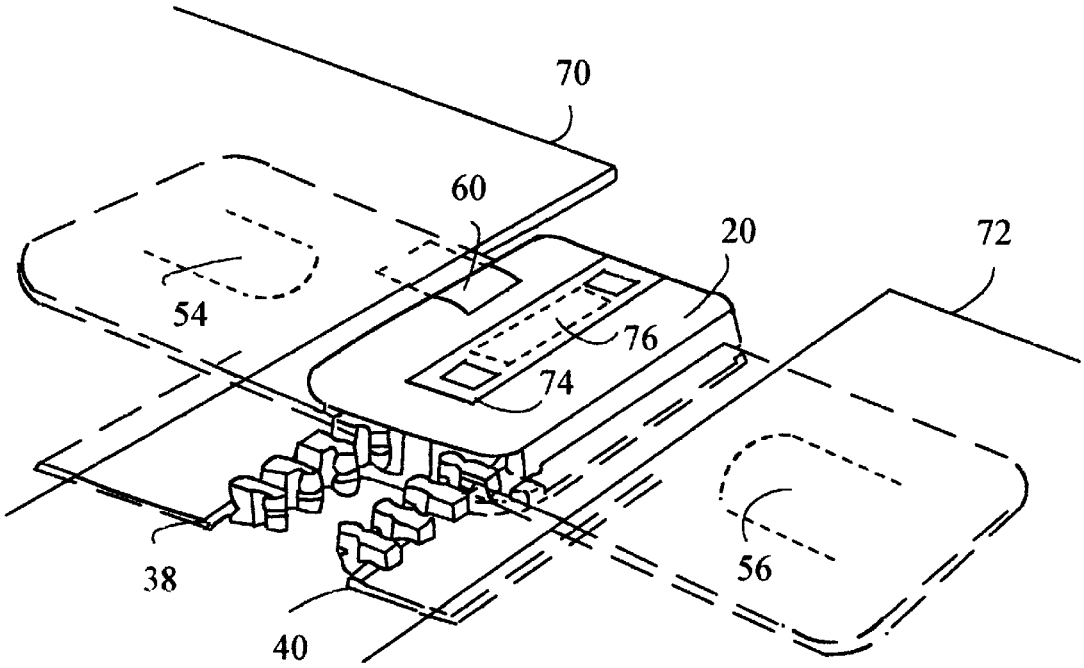
Figure 20B:
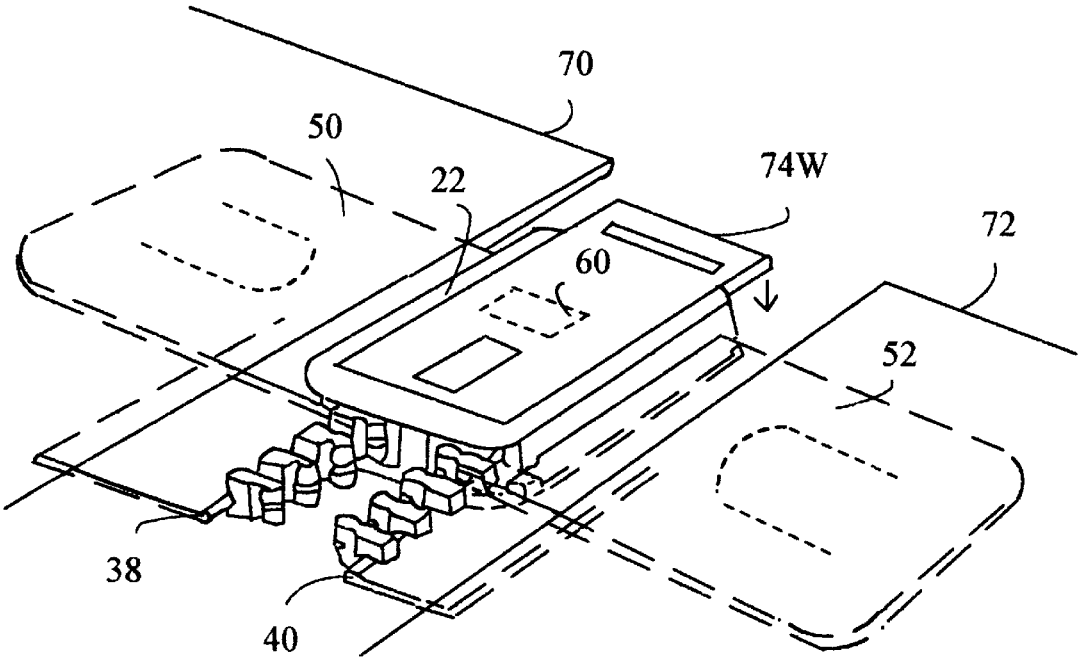

FIGS. 20A–B are perspective views of recessed zipper pulls and a planar surface on the integrated zipper.

Figure 1A:
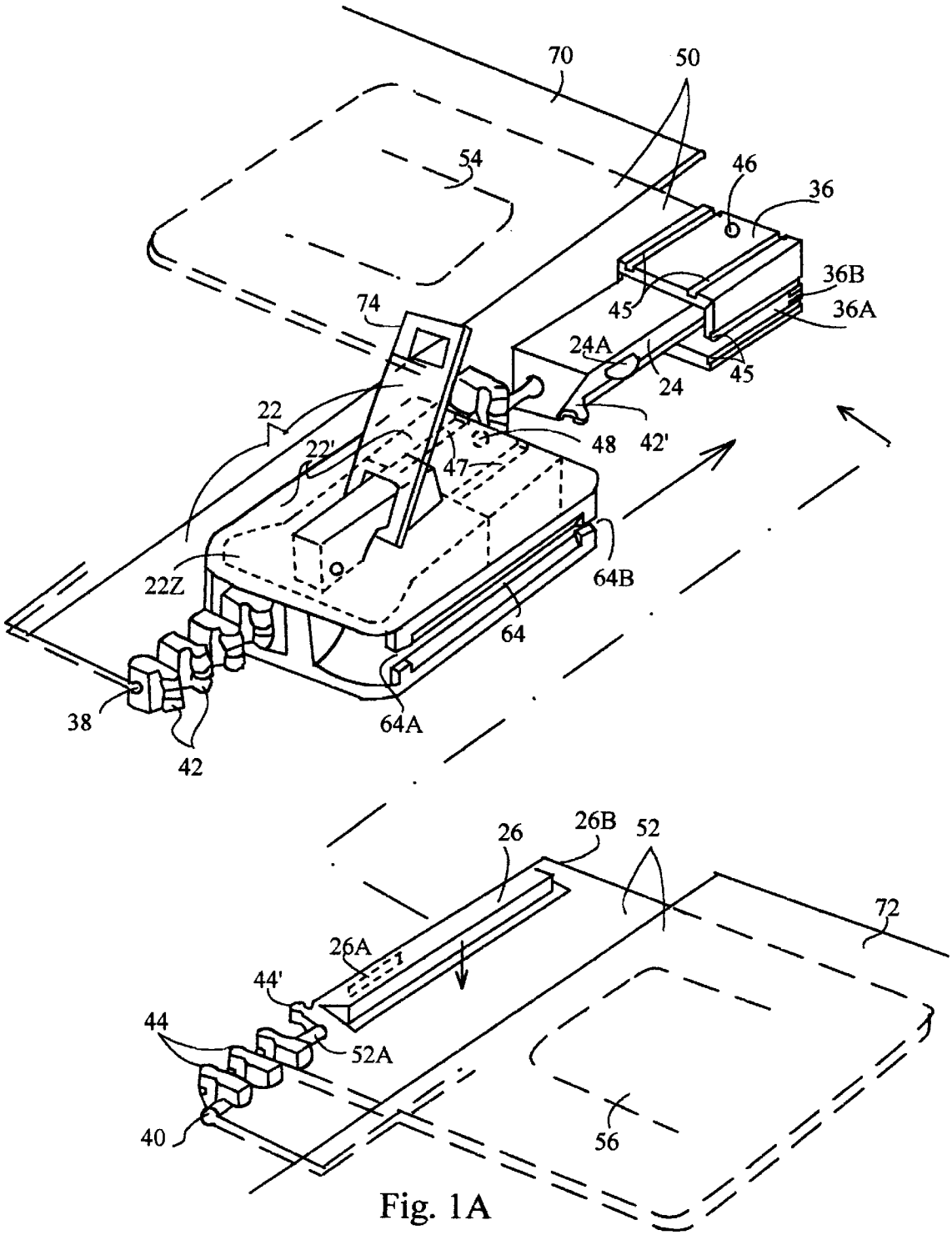
FIG. 1A, is a perspective view of an integrated, zipper system, according to my invention.
Figure 1B:
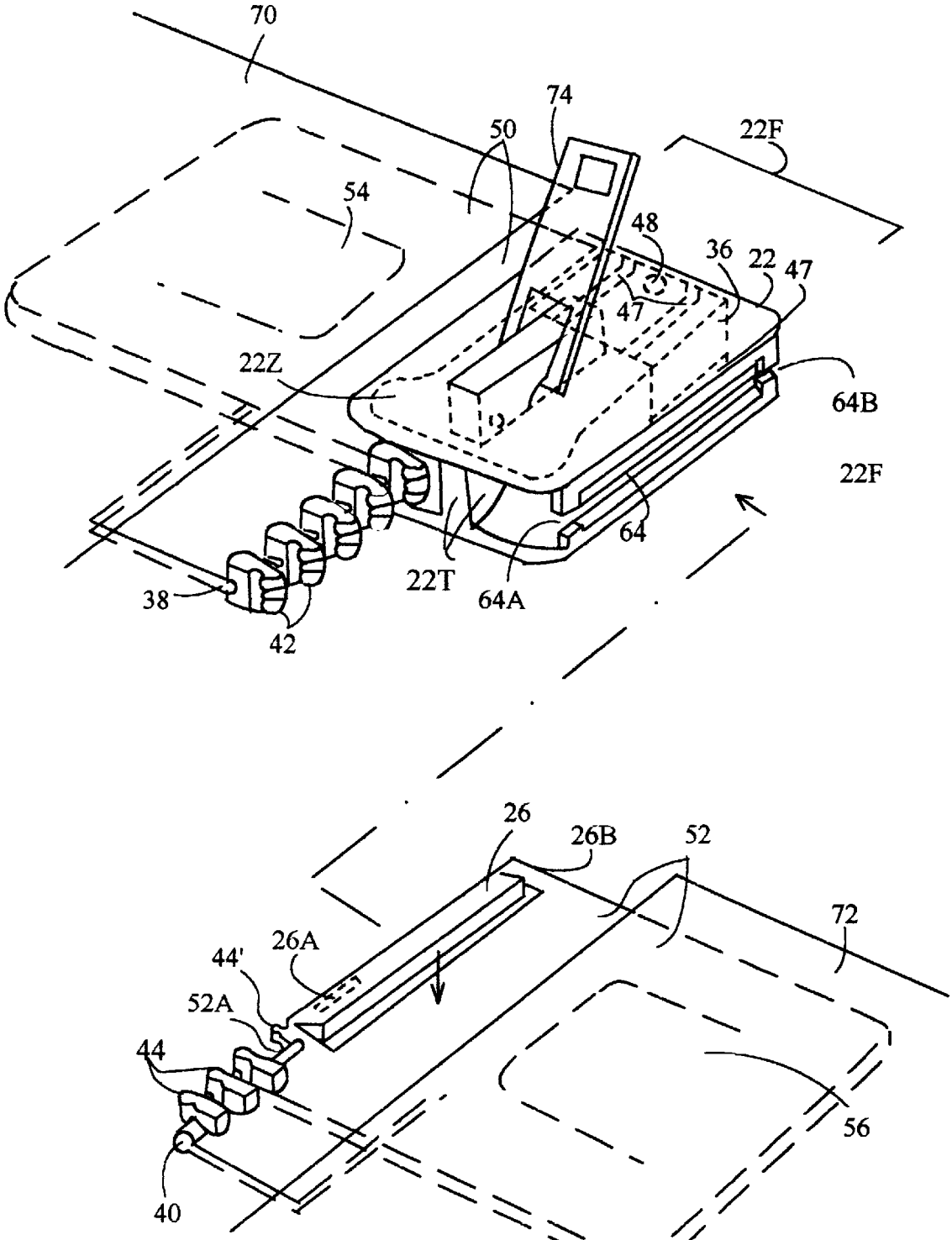
FIG. 1B, is a perspective view of FIG. 1A, where the movement of the female members is arrested, for lateral coupling with a resilient male pin.
Figure 1C:
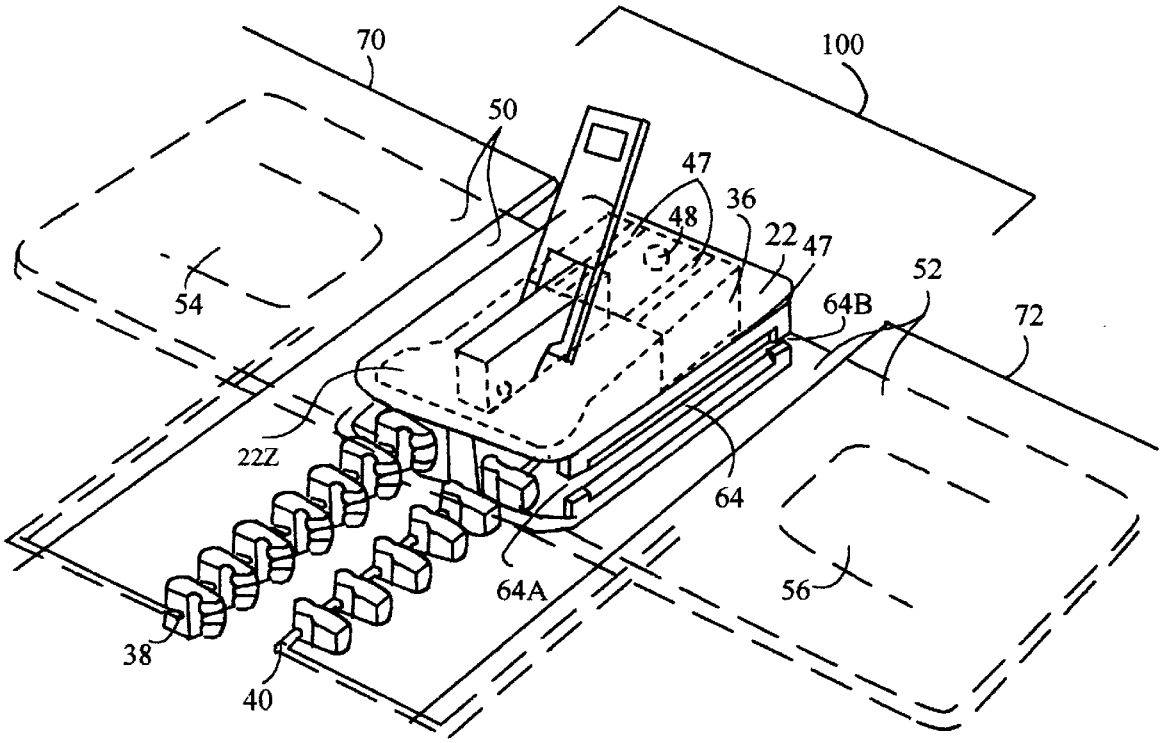
FIG. 1C, is a perspective view of FIGS. 1A and 1B, after initial lateral coupling of the zipper.

FIGS. 21A–F are cross-sections of modifications of the socket member illustrated in FIGS. 1A–C.

REFERENCE NUMERALS IN DRAWINGS

| | |
|---|---|
| 22 | coupling slider of 22Z |
| 22Z | sliding zipper head |
| 22' | extended coupling and integrating structure of 22Z |
| 22F | integrated female unit |
| 22L | full length zipper head |
| 22N | zipper head integrating panels |
| 22P | zipper head integrating plugs |
| 22S | shortened integrating structure of 22 |
| 22T | dividing triangle of 22Z |
| 23 | two-way coupling slider |
| 23Z | two-way zipper head |
| 23' | extended coupling and integrating structure of22Z/23Z |
| 23F | two-way integrated female unit |
| 24 | stationary pin |
| 24A | protrusion on pin 24 |
| 24C | stationary pin bulge |
| 24D | stationary pin recess |
| 26 | interlocking male pin |
| 26' | resilient/non-resilient male pin |
| 26A | recess on pin 26 |
| 26B | bottom edge of 26 |
| 26C | conventional male pin |
| 26D | pin abutment |
| 26E | varied two-way flange pin |
| 26F | three short flange pin |
| 26G | two long flange pin |
| 26H | nesting flange pin |
| 26I | lower edge narrow flange pin |
| 26J | lower edge wide flange pin |
| 26K | full edge narrow flange pin |
| 26L | full edge wide flange pin |
| 26M | short flange with non-resilient edge |
| 26N | resilient pin with teeth |
| 28 | narrow resilient locking assembly |
| 28A | spring of assembly 28 |

-continued

| | |
|---|---|
| 30 | wide resilient locking assembly |
| 32 | narrow non-resilient male pin |
| 34 | wide non-resilient male pin |
| 34' | void of pin 34 |
| 36 | socketbox |
| 36' | coupling socket assembly |
| 36A | socket box side entrance |
| 36B | socket box bottom opening |
| 36C | socket box upper opening |
| 36P | socket integrating plugs |
| 36N | socket integrating panels |
| 36S | socket voids for 22D |
| 38 | 1st elongated coupling element |
| 40 | 2nd elongate coupling element |
| 40' | aligning tooth on 26' |
| 42 | 1st elongated zipper teeth |
| 42' | partial tooth of 42 |
| 44 | 2nd elongated zipper teeth |
| 44' | partial tooth of 44' |
| 45 | interacting grooves |
| 45' | interacting tongues |
| 46 | snug bump |
| 48 | snug recess |
| 50 | 1st intergarment plate |
| 52 | 2nd intergarment plate |
| 52A | intergarment plate edge |
| 52G | grooved inset in plates 50/52 |
| 54 | 1st recessed thumb hole |
| 56 | 2nd recessed thumb hole |
| 58 | stitching |
| 60 | release button |
| 62 | release button mechanism |
| 64 | entrance |
| 64' | differentiated entrance |
| 64A | entrance upper opening |
| 64B | entrance lower opening |
| 64S | socket assembly entrance |
| 66 | resilient material |
| 68 | solid buckle edge |
| 70 | lst elongated fabric |
| 72 | 2nd elongated fabric |
| 74 | zipper pull |
| 74A | zipper pull of 22A |
| 74C | resilient coil of 74 |
| 74T | interacting tab of 74 |
| 74V | interacting void for 74T |
| 74W | wide zipper pull |
| 76 | magnet (s) |
| 78 | resilient bridge |
| 80 | large top/small bottom male pin |
| 80A | stationary pin of pin 80 |
| 82 | upward flange male pin |
| 82A | stationary pin of pin 82 |
| 83 | resilient pin with spring |
| 83A | stationary pin of 83 |
| 84 | filled resilient male pin |
| 84A | stationary pin of pin 84 |
| 86 | arrow shaped male pin |
| 86A | stationary pin of pin 86 |
| 90 | resilient pin with framework |
| 90A | stationary pin of pin 90 |
| 90H | hole in pin 90 |
| 92 | elastic or strap holder |
| 94 | wide elastic or strap holder |
| 96 | elastic |
| 98 | interacting magnet |
| 99A | short tapered socket box |
| 99B | short socket box/tall taper |
| 99C | tall socket box/flat top |
| 99D | tall socket box/tapered top |
| 100 | two-piece interlocking buckle |

SUMMARY

In accordance with the present invention, I provide a zipper system in which the movement of the members on the female side of the zipper system are arrested during coupling and uncoupling of the zipper. The members on the female side of the zipper are first integrated and coupled with each other to form a single integrated female unit or socket which is then coupled with the male side of the zipper. The female members include a sliding coupling zipper head and a coupling socket member, (or other female members), located on one of two elongated coupling elements. The female members couple and hold each other to arrest the movement of the female members for coupling and uncoupling with the male interlocking element. Coupling the female members and arresting their movement provides for easy and instant coupling with the male interlocking element. This zipper can be coupled quickly and reliably, time after time, without any movement of the female members, especially the sliding zipper head. Preventing movement of the sliding zipper head, during coupling is an immense benefit to a laterally coupled zipper. This zipper system can be coupled laterally, or coupled conventionally from the top, according to my invention.

Figure 7:
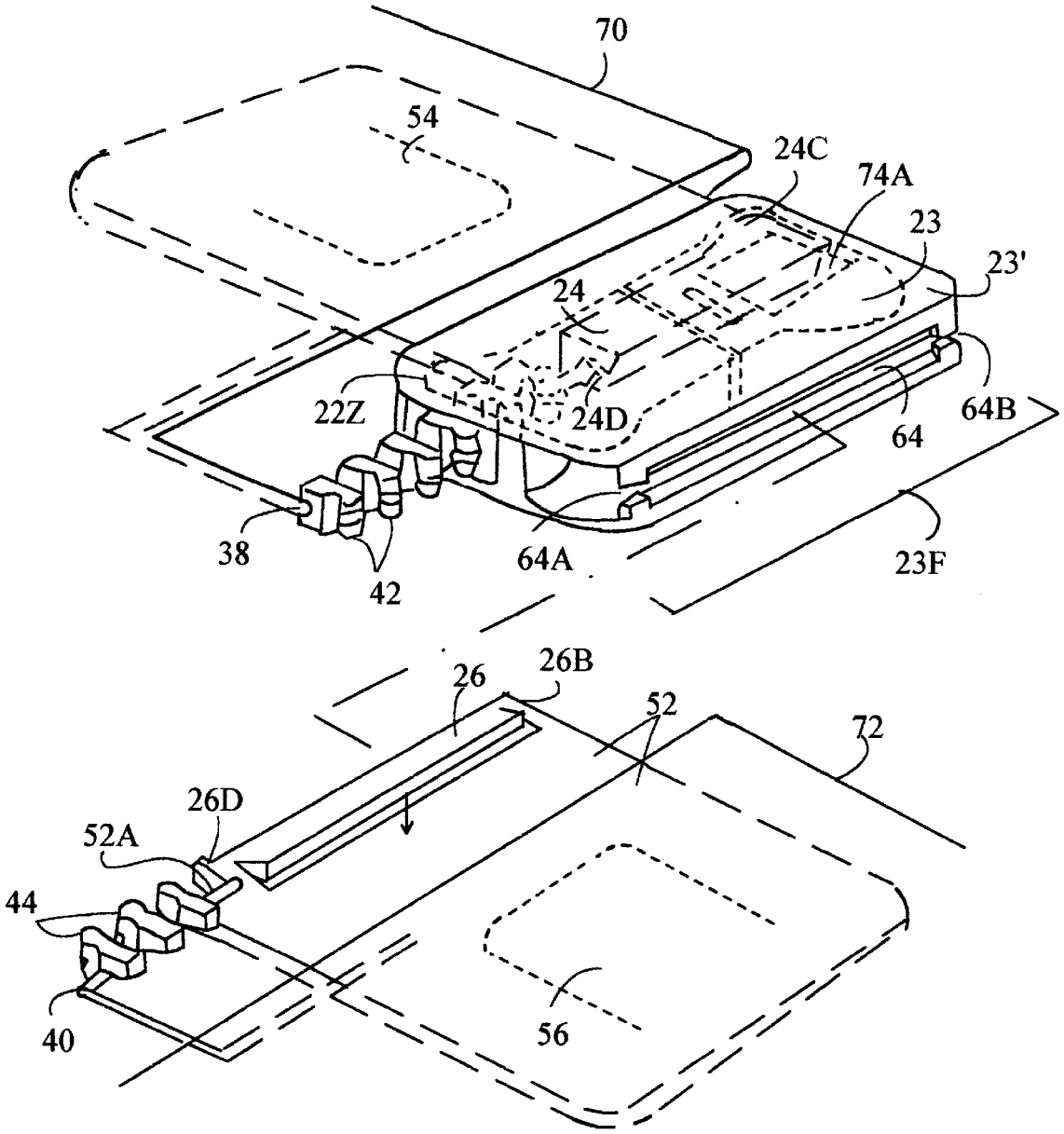
FIG. 7 is a perspective view of a sixth embodiment of the integrated zipper system, according to my invention, illustrating a twoway zipper.

This closure system can be coupled with a resilient male interlocking pin, a non-resilient male interlocking pin and an interlocking male pin that is partially resilient and partially non-resilient in selective embodiments. Resilient male interlocking pins are used in embodiments 1, (FIGS. 1A–C), 4 (FIG. 2) and 6 (FIG. 7). The second embodiment (FIG. 2) uses a male interlocking pin that has both resilient portions and non-resilient portions to couple the closure system. A totally non-resilient pin is used in the seventh embodiment (FIGS. 8A–C) and in the eighth embodiment (FIGS. 9A and B) Modifications of resilient male interlocking elements can be seen in FIGS. 12G–12P, 13A–C, 14A–C, 14A–C, 15A–C, 16A–C, 17A–C, 18A and B.

This new integrated zipper is fun and amazingly easy-to-use because of its immobile integrated members, wide coupling aperture, unified socket, and easy snap-in pieces. This integrated zipper system can be used for lightweight and heavy duty use, reversible and non-reversible items, separable and non-separable zippers, two-way zippers, tongue and groove plastic zippers, back to back zippers found on luggage, and many other applications.

FIGS. 1A–C—Description of First Embodiment—Integrated Zipper System Coupled Laterally with Resilient Male Pin A perspective view of a preferred embodiment of the present zipper is illustrated in FIGS. 1A–C. FIGS. 1A–C are a series of three figures showing the structure and operation of the first embodiment. FIG. 1A shows the members of the integrated zipper system before integration of the zipper takes place. FIG. 1B shows the integrated zipper system after the members of the female side of the zipper are integrated, before coupling with the male side of the zipper. FIG. 1C shows the initially coupled zipper.

Coupling element 38 has a set of zipper teeth 42. A second elongated coupling element, or fabric strip 40 has a second set of zipper teeth 44. Coupling element 38 is lockable along its length to coupling element 40 via intermeshing of first and second zipper teeth 42 and 44. Coupling elements 38 and 40 have woven fabric strips (or other method) which are sewn or secured to edges or openings of fabric 70 and 72, respectively, on two edges of a garment or article of manufacture, such as a sleeping bag or a jacket.

Head 22Z is slidably connected to coupling element 38. Head 22Z is molded with, works with (or has by other method) an extended integrating, arresting and coupling structure 22', which extends beyond and below head 22Z (or similar device), for coupling with, integrating and arresting the movement of the members on the female side of the zipper. Sliding zipper head 22Z with coupling structure 22' is hereafter called coupling slider 22. Coupling slider 22 integrates and couples with an immobile socket box 36, which arrests the movement of coupling slider 22. Coupling slider 22 is made of plastic, metal or other material. Coupling slider 22 is drawn in a first direction to the initiating end of coupling element 38 and encompasses box 36. This couples and integrates coupling slider 22 with box 36, unites them into a single unit and arrests their movement. Box 36 when inside coupling slider 22, provides a bottom to coupling slider 22.

Coupling slider 22, and all the integrating structure and members, in accordance with this invention, has complimentary structure with the other members to provide planar or smooth interior and exterior surfaces to the integrated and coupled female unit or socket This coupled female unit will be referred to as 22F. This smooth surface also provides an aesthetic appearance, and a surface for animated pictures for teaching children how to use the zipper. This complimentary structure also provides a single entrance with the equivalent of a single thickness to the entrance for ease of coupling.

Coupling slider 22 when drawn in a first direction, encompasses box 36, engages interacting tongues 45' (male) with interacting grooves 45 (female) and engages interacting snug bump 46 (male) with interacting snug recess 48 (female) which further integrate the members on the female side of the zipper to arrest movement of the members and align their entrances. Integrating structure 22', and zipper head 22Z becomes coupling slider 22. Coupling slider 22's purpose is to integrate or couple head 22Z with box 36, temporarily attaching head 22Z to the immobilized box 36, to form coupled female unit 22F. This in turn immobilizes head 22Z and arrests the movement of the two members, especially head 22Z, during coupling and uncoupling of the zipper system. These integrating features also align and integrate their predetermined entrances for easy snap-in lateral coupling. During lateral coupling, coupled female unit 22F becomes the female or socket-half of a laterally coupled buckle (which includes a sliding zipper head, as mentioned above).

Coupling slider 22 has a planar surface since a zipper pull 74, equipped with a magnet 75, (or other method) is flatly set into its surface, as illustrated in FIGS. 20A–B when coupling slider 22 is not being drawn in a first or second direction by pull 74. Head 22Z extends the full length inside coupling slider 22 in some embodiments. Coupling slider 22 is designed to fully encompass and hold box 36 to unite the female members for perfect alignment during initial coupling of the zipper.

Coupling slider 22 is equipped with a laterally guiding and compressing framework or tapered entrance 64 on its separable side, similar to the entrance or opening of the female half of the above two-piece modem snap-together interlocking buckle or automobile restraint seat belt buckle. Entrance 64 has an upper opening 64A and a lower opening 64B to allow coupling slider 22 to slide for the operation of the zipper. Upper opening 64A also allows a reinforced or braced (section) edge 52A on second elongated coupling element 40 and zipper teeth 44 to pass through, above entrance 64, for alignment over coupling slider 22 for initial coupling of first elongated coupling element 38 to second elongated element 40. Entrance 64 has a lower opening 64B which allows a lower edge of pin 26, edge 26E, to pass through during coupling to ensure proper alignment. Coupling slider 22 slides in a first direction to encompass box 36, and arrest the movement of head 22Z. Box 36 is then concealed within coupling slider 22. Box 36 is slightly smaller than the confines of coupling slider 22 and fits easily within coupling slider 22 (and fits within head 22Z itself, in some applications) when coupling slider 22 is drawn over box 36. A resilient male interlocking pin 26, located on the end of coupling element 40 (FIGS. 1A–C), mates laterally with slider 22 and box 36, initially coupling the zipper, in this embodiment.

Box 36 has a side entrance 36A. Sliding coupling slider 22 over box 36 engages tongues 45' on the underside of structure 22' with grooves 45 in the top, (or elsewhere) of box 36. Entrance 36A is constructed to act as tongue and groove interacting structure with the interior of entrance 64 when coupling slider 22 is lowered over box 36. This interacting structure, provides an unencumbered, combined entrance with the equivalent of a single thickness for smooth entry of pin 26 during coupling. This interacting structure may be in addition to, or in lieu of, other interacting structure, and may be used with a socket box of any height. The exterior of entrance 36A interacts with the interior of entrance 64. This interacting structure may not be apparent from the exterior of coupling slider 22. Sliding coupling slider 22 down over box 36 also engages snug bump 46 on the top of box 36 (or elsewhere) with a snug recess 48, located on the underside of coupling slider 22 (or elsewhere). Engaging these male and female interacting structures add to the integration and unification of the members for coupling. The dimensions (including height) of socket member 36 are determined by the embodiment used. Box 36 may be partially the height of a stationary pin 24 and width of pin 26. Box 36 may be full height within head 22Z or within coupling slider 22 and totally encase a stationary pin 24 providing a full width socket entrance for pin 26. The exterior of entrance 36A interacts with the interior of entrance 64 to provide an entrance with the equivalent of a single thickness.

Stationary pin 24 is a one-piece unit extending from or within member 36. Pin 24 is specifically located on and connected to coupling element 38. Pin 24 is a complimentary element sometimes to pin 26 and takes up the space not taken by pin 26 in box 36. On pin 24 is a protrusion 24A with tapered sides, that fit in a recess in 26A when coupled. Pin 24 also has a partial zipper tooth 42' that engages a complimentary partial zipper tooth 44' on pin 26 when coupled. Stationary pin 24 is considered a integrating and coupling female member in some embodiments, especially while incorporated in twoway zipper system or if a stationary pin does the work of a socket member.

When pin 26 is pushed into entrance 64, engaging recess 26A with protrusion 24A and tooth 42' with tooth 44' during coupling, pin 26 forces coupling slider 22 to move all the way down as far as it can go on coupling element 38. This is an automatic alignment method that automatically aligns coupling element 38 and coupling slider 22 with coupling element 40, if coupling slider 22 was not already positioned all the way down on coupling element 38. Pin 24 is the outermost part and extension of a bracing stiff intergarment plate or handhold 50, located partially within, and extending beyond, fabric 70.

Resilient pin 26 is the outermost part and extension of a complimentary intergarment plate or handhold 52 located on coupling element 40 on the respective opposite edge or opening of the garment. Intergarment plate 52 is partially within and extends beyond and into fabric 72. Plate 52 is further located on and connected to coupling element 40. First and second recessed thumb holds 54 and 56 are located in the center top of plates 50 and 52, respectively. These provide recesses or push guides which accommodate the user's thumbs when the zipper is being coupled.

Intergarment plates 50 and 52 become part of and fortify the initial zipper teeth of teeth 42 and 44. This straightens and fortifies the beginning of coupling elements 38 and 40 so pin 26 snaps in easily, time after time, through entrance 64 and is well protected from repeated use. Plate 50 is imbedded in and extends from box 36. The immobility of plate 50 and box 36 further arrests the movement of the female members when coupling slider 22 (or other zipper head structure) integrates and couples box 36. Plate 52's accessible intergarment edge 52A fits through upper opening 64A in entrance 64 when pin 26 is pushed into entrance 64. During coupling, element 40 and teeth 44, connected to edge 52A, slide over entrance 64 and are aligned for coupling along their length to first elongated coupling element 38. Edge 52A, imbedded in one or more zipper teeth 44, insurers that the first of the interlocking teeth and partial tooth 44' on element 40 properly initially engages the first zipper teeth and partial zipper tooth 42' on element 38 for coupling along their length. Protrusion 24A, with its tapered sides engage recess 26A at this time and actively moves pin 26 and coupling element 40 to the right place by pushing the tapered sides of protrusion 26A against the top or bottom edge of 24A for proper automatic alignment.

Intergarment plates 50 and 52 are sewn (or otherwise attached) on the inside of fabric 70 and 72, respectively. They are positioned along the starting edges of coupling elements 38 and 40. Intergarment plates 50 and 52 extend out of fabric 70 and 72 to hold the interlocking pins and to fortify initial zipper teeth for proper and automatic alignment The portion of intergarment plates 50 and 52 that are inside the fabric are not seen, but can be felt by the user or wearer. Plates 50 and 52 can be various sizes and angles for accommodating the fingers and the palms of the hands of children and adults as well as for different uses of the garment or article.

Upper edge 52A and lower edge 26B of pin 26 simultaneously slide through upper and lower openings 64A and 64B of entrance 64, guiding the resilient portion of pin 26 through entrance 64 into perfect alignment with stationary pin 24. Pin 26 has the ability to compress to the same plane as plate 52 and recede into plate 52 when compressed by entrance 64 and rebound to its original shape once inside unit 22F, locking pin 26 in place. Inserting protrusion 24A into recess 26A during coupling additionally ensures that stationary pin 24 and pin 26 fit together at the right place along their length and to help keep pin 26 from riding up when coupling slider 22 is drawn in a first or closing direction.

The pressure needed to lock pin 26 can be very light or more substantial depending upon the density and tenacity of the resilient material being used and the amount of snap sound desired. A light funnel or conical-shaped spring in a pin 66 requires very little pressure to couple pin 66, yet when locked, pin 66 has the staying power of a formidable lock because it is the restraining edge of pin 66 that keeps pin 66 locked in place. Resilient pin 26 is designed as part of a supporting framework having an open slot, hole or recess. This framework allows for a strong interlocking pin without bulk, for ease of fitting through entrance 64 for coupling the zipper system. Very little surface area of pin 26 (or any of the resilient pins) is needed to interlock with the restraining edge of coupling slider 22 and box 36 to provide a very strong hold. Entrance 64 is located on the open or separable side of coupling slider 22. The thickness of woven strips 38A, 40A and height of teeth 42 and 44 are determined by the aperture needed for pin 26.

Unit 22F and male interlocking pin 26 (or other interlocking male pins) can both have rigid structure located on the respective inner initiating edges (or elsewhere) of elongated coupling elements 38 and 40 to provide a two-piece, laterally coupled, snap-together interlocking buckle 100. Unit 22F (the united members on the female side of the zipper) becomes the female half of interlocking buckle 100. The male interlocking pin becomes the male half of interlocking snap-together buckle 100. The male half when laterally pushed into unit 22F instantly couples the zipper, initially locking elongated coupling 38 with elongated coupling element 40. After the male and female halves are coupled, coupling slider 22 (the sliding member of unit 22F) is lifted and uncoupled from socket box 36 and is drawn in a coupling direction to couple the full lengths of coupling elements 38 and 40.

FIGS. 1A–C—Operation of the First Embodiment, Including Automatic Alignment Method and Operation of the Resilient Male Interlocking Pin The zipper of FIGS. 1A–C is used to close a garment (or other two-piece article, such as a tent, suitcase, etc.) and open it again. Its operation with a jacket, such as a ski jacket, will be discussed.

To don a jacket with the present zipper assembly, (FIG. 1A) the user moves coupling slider 22, containing head 22Z, and structure 22' in a first direction along coupling element 38 to one end, (as shown by the direction of the long arrow in FIG. 1A). Coupling slider 22 slides over box 36 engages tongues 45' on the underside of structure 22', with grooves 45 in the top (or elsewhere) of box 36. Tongues 45' on the underside of entrance 64 also slidably engage grooves 45 in entrance 36A to provide an unencumbered, integrated, arrested and smooth entrance for the coupling of pin 26. Coupling slider 22 drawn in a first direction over box 36 also engages snug bump 46 on the top of box 36 (or elsewhere) with snug recess 48, located on the underside of coupling slider 22 (or elsewhere).

Sliding coupling slider 22 over box 36 temporarily attaches head 22Z to the immobile box 36, (FIG. 1B) which in turn, arrests the motion of head 22Z, and aligns entrance 64 with entrance 36A, integrating, coupling and arresting the movement of sliding coupling slider 22 and box 36. Coupling slider 22 encompasses pin 24 and member 36, forming coupled female unit 22F. Box 36 is slightly smaller than the inside dimensions of coupling slider 22 and fits easily within coupling slider 22 when coupling slider 22 is drawn over it in this first direction. The vertical movement is arrested by the confines of coupling slider 22 and bump 46 and recess 48. Horizontal movement is arrested by coupling slider 22 and tongues 45' and grooves 45 . The female side of the zipper system is now coupled, the members united, and all movement is arrested for lateral coupling with the male side of the integrated zipper system. The integration of head 22Z and box 36 temporarily combines head 22Z and box 36 into a single unit 22F so it becomes the united female half or socket-half of a modem, laterally coupled, snaptogether buckle 100.

To couple the integrated zipper, (FIG. 1B), the user holds the waistband of fabric 70 with one hand and the waistband of fabric 72 with the other, aligning fabric 70 and 72 along the same plane. The user positions their hands on plates 50 and 52, respectively, mostly hidden within fabric 70 and 72 (or positions them on coupling slider 22 and plate 52). Specifically the user positions their thumbs on recessed thumb holds 54 and 56, with the tips of their thumbs facing each other. With a direction horizontal to the operation of coupling socket 22, the user pushes pin 26 into coupled female unit 22F and unified entrance 64. Pin 26 compresses in tapered entrance 64 when pushed, and compresses and recedes to within the thickness (or whatever needed) of intergarment plate 52 and remains compressed until it passes into box 36 and coupling slider 22 (unit 22F), where it finds a void, snaps-up and quickly returns to its pre-compressed state, locking pin 26 in place. The front edges of the resilient portion of pin 26 can be tapered for guiding pin 26 into place if needed. This places pin 26 alongside pin 24, and fits protrusion 24A into recess 26A, coupling the zipper.

Pushing pin 26 into entrances 64 and 36A, the automatic fitting of protrusion 24A, with its tapered sides into recess 26A, and the alignment of partial tooth 44' on plate 52 with partial tooth 42' on plate 50 forces coupling slider 22 to move all the way down on element 38 engaging snug bump 46 with recess 48. This automatic alignment method and lateral coupling by pin 26 provides perfect snap-in alignment, time after time, and corrects the position of coupling slider 22 if it is slightly above the initiating edge of the zipper when the user couples the zipper.

When pin 26 is pushed into entrance 64 for coupling, the upper part of intergarment plate 52, edge 52A, simultaneously passes through upper opening 64A allowing second elongated 40 and teeth 44 to pass above entrance 64 (partial tooth 44' passes inside entrance 64). This positions elongated 40 and teeth 44 above coupling slider 22 for intermeshing. (FIG. 1C) The user listens for an audible snap, which occurs when pin 26 snaps back to its original state, locking it in place inside coupled female unit 22F. This gives the user assurance that coupling has taken place. Coupling is just as effective if the user positions one hand on coupling slider 22 and one hand on plate 52 for coupling.

To couple the zipper along its length, the user releases their hold from plate 52 and with the same hand, lifts pull 74 from its recessed position in coupling slider 22. This recessed position is aided by magnet 76, resilient coil 74C, resilient bridge 78, gravity, or other method. The user pulls pull 74 and coupling slider 22 in a second direction, opposite to the first direction, intermeshing teeth 42 on coupling element 38 with teeth 44 on coupling element 40. This locks elements 38 and 40 together along their length. Coupling slider 22, when moved this second direction along elements 38 and 40, visually uncovers box 36 which remains immobile at the initiating edge of coupling element 38 and is the basis of the interconnection between coupling elements 38 and 40. Box 36 may be different heights in different embodiments or applications.

During the uncoupling process of the first embodiment, the user pulls pull 74 and coupling slider 22 in an opposite direction to the coupling process along elements 38 and 40, uncoupling teeth 42 and 44. When coupling slider 22 is drawn to the initiating edge of coupling element 38, it again integrates and couples the members of the female side, encompasses member 36, and arrests all movement of head 22Z and box 36. Pin 26 is then removed from the top of coupling slider 22 in a direction opposite to the uncoupling process, totally separating coupling element 38 from coupling element 40. (resilient male interlocking pins in other embodiments, can be removed with a release button (FIGS. 12K–12N) which depresses pin 26 allowing it pass through entrance 64 and 36A to be removed laterally, in a direction opposite from the way it entered.)

A garment having this new zipper system couples reliably and easily time after time. This zipper having two-piece buckle 100, initially couples as easily as snapping together a two-piece lateral, snap-in buckle, which quickly snaps the two initiating edges of the garment together. The elongated coupling elements are automatically aligned during coupling and are ready to be zipped up. There is no straining to try to find a small narrow aperture in which to carefully thread the pin or push it aimlessly or strenuously into place, nor is there any fumbling to hold small pieces together, nor a need to remove ones gloves. My "snap-start zipper" is well fortified and will last as long as the article to which it is attached, thereby enabling such garments to last longer than those using prior-art zippers. The young and the old and all those in between will be delighted with the ease of this quick coupling, fun-to-use zipper.

Figure 2:
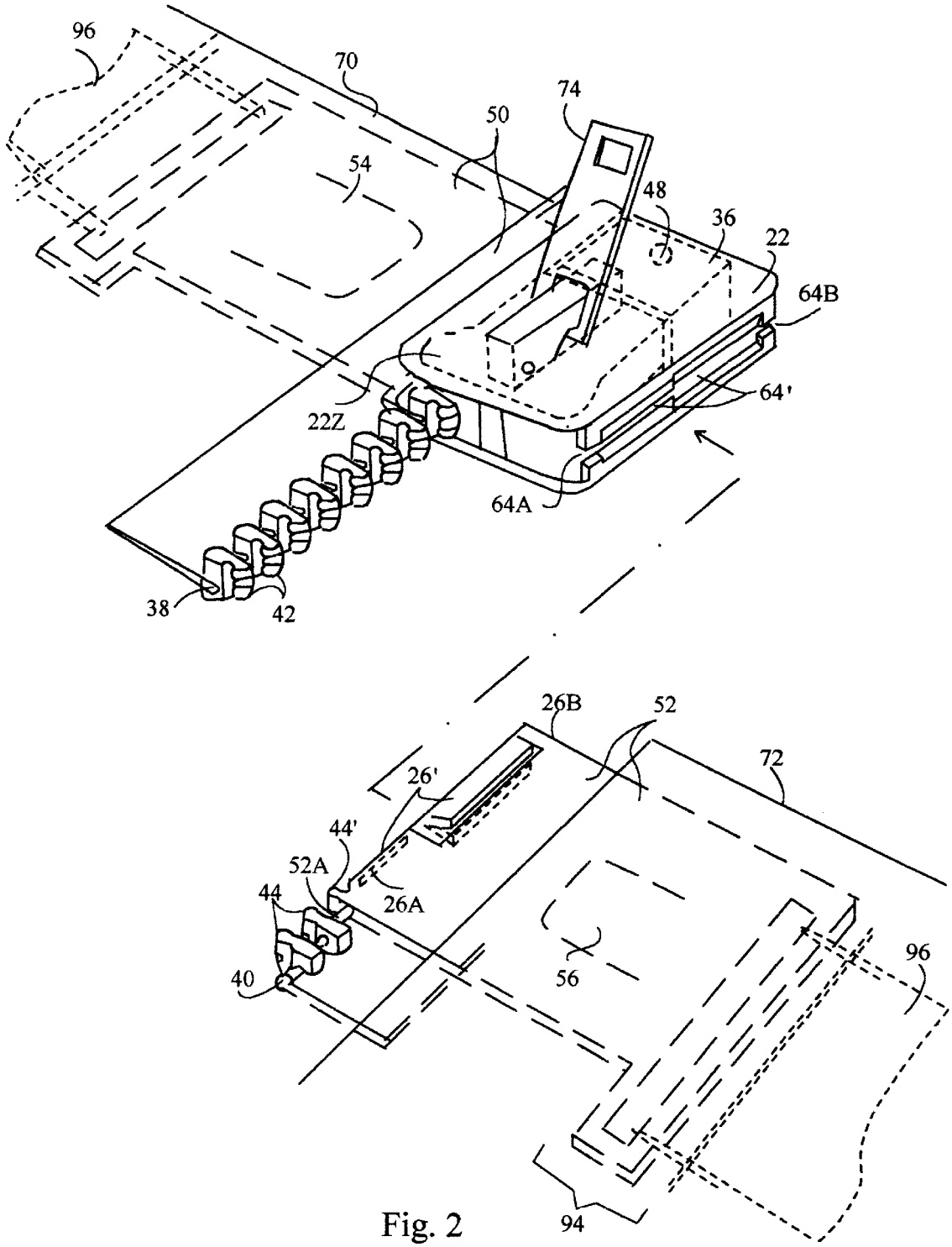
FIG. 2 is a perspective view of a second embodiment, according to my invention.

FIG. 2—Description of Second Embodiment—Integrated Zipper Having a Differentiated Male Interlocking Pin with Resilient and Non-Resilient Portions Coupling With a Corresponding Differentiated Lateral Entrance A perspective view of the present zipper, in accordance with the invention, illustrates coupled female unit 22F having a differentiated entrance for locking with a corresponding differentiated male interlocking element, in FIG. 2. FIG. 2 shows similar structure to FIG. 1, where head 22Z has extended integrating and arresting structure 22' which together with head 22Z becomes coupling slider 22. Coupling slider 22 has integrated and coupled box 36 in FIG. 2, to provide coupled female unit 22F on the female side of the zipper having a single aligned entrance. The entrance of coupling slider 22 in this embodiment is differentiated. Differentiated entrance 64' has two different size apertures. The upper portion, or zipper head portion, of entrance 64' is narrow. The upper portion of entrance 64' accommodates a correspondingly narrow non-resilient or recessing resilient portion (FIG. 12H) of resilient pin 26' for lateral coupling. The lower portion, or socket member portion of entrance 64' is wide. The lower portion of entrance 64' accommodates a correspondingly wide resilient portion of resilient pin 26', for lateral coupling. The lower portion of pin 26' has a pair of opposite deflecting flanges.

Intergarment plate 50 has a wide strap holder 94, which is wider than the regular width of intergarment plate 50, to hold a wide elastic band of material 96 (or other strap) commonly found in the waistband of a jacket. Intergarment plate 52 has a corresponding wide strap holder 94' which holds the opposite end of the elastic band 96, attached to intergarment plate 50. Elastic band 96, attached to intergarment plate 50 on the initiating end of coupling element 38, reaches around the back of the jacket and returns to the front of the jacket where it is attached to intergarment plate 52 on the initiating end of coupling element 40. A large portion of intergarment plates 50 and 52, holders 94 and 94' and the attached elastic band 96 are located inside the waistband of the jacket.

FIG. 2—Operation of the Second Embodiment Including a Male Interlocking Pin Having Resilient and Non-Resilient Portions To couple the second, differentiated embodiment, coupling slider 22 is drawn to the initiating edge of coupling element 38, encompassing box 36. Coupling box 36 with coupling slider 22 arrests the movement of head 22Z and box 36 to form coupled female unit 22F having a single, integrated entrance 64'. The user holds intergarment plates 50 and 52 to bring the edges of the jacket together along the same plane. The user laterally pushes pin 26' into entrance 64', fitting intergarment plate edge 52A into upper opening 64A and lower edge 26E into lower opening 64B. The upper portion of pin 26 has a predetermined thickness, is non-resilient FIG. 2 (or is resilient and recesses within itself, (FIG. 12H ) and slips into the integrated and immobilized head 22Z, where partial tooth 44' engages partial tooth 42'. The lower portion of pin 26' is simultaneously pushed into the coupled socket box 36 inside entrance 64'. The lower portion, having a pair of opposite, resilient, deflecting flanges, compresses in entrance 64' and quickly snaps back when inside box 36, initially locking the zipper.

Figure 3A:
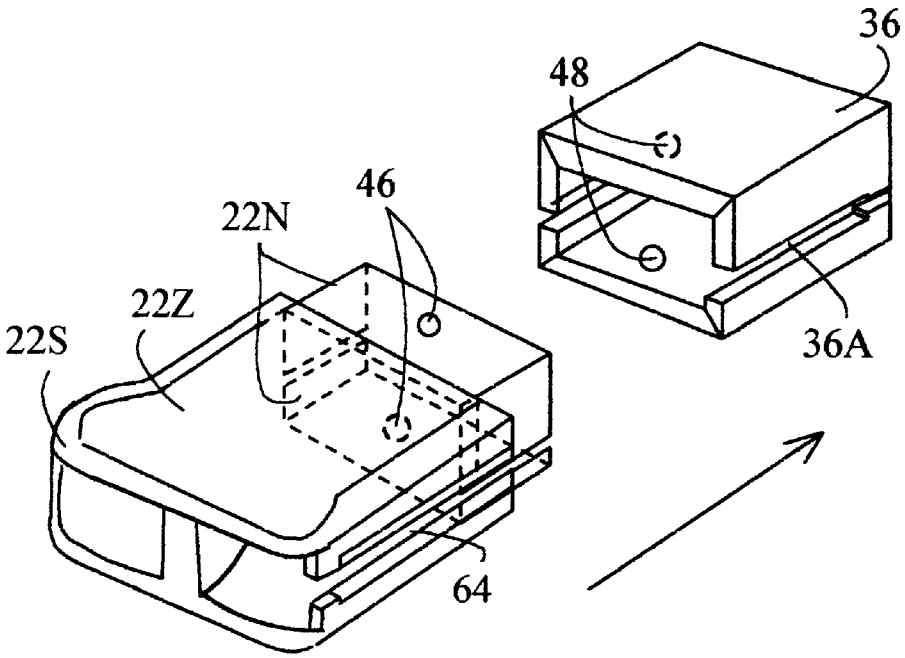
FIG. 3A is a perspective view of a third embodiment, according to my invention.
Figure 3B:
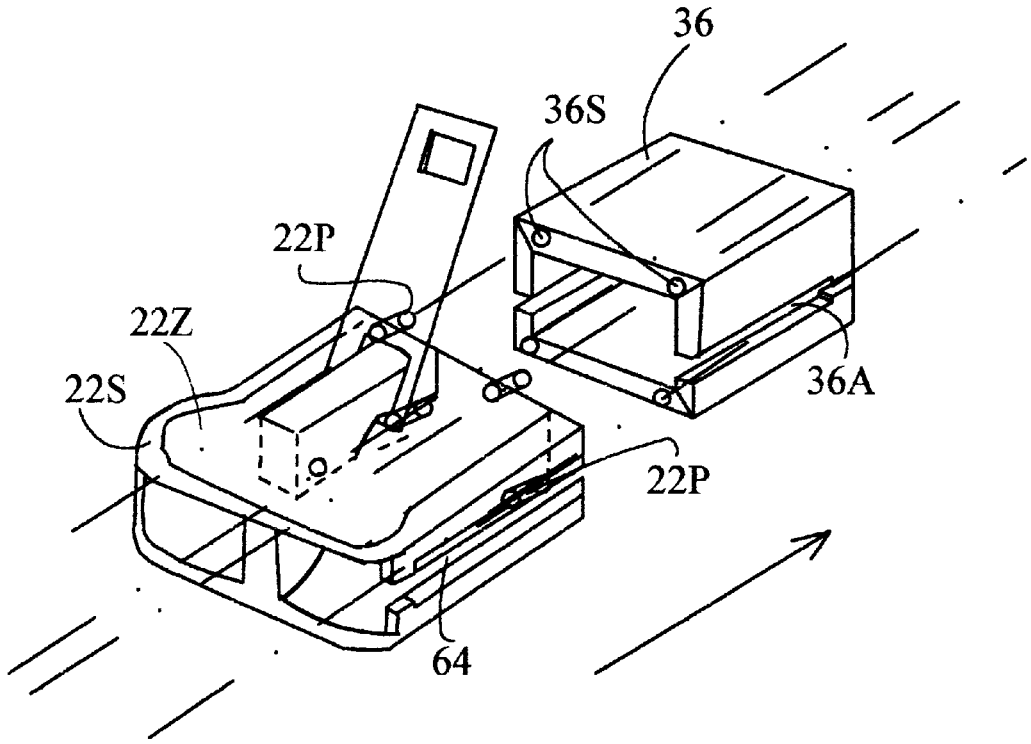
FIG. 3B is a perspective view of a modification of the third embodiment.

FIGS. 3A–B—Description and Operation of the Third Embodiment—Two Illustrations of the Sliding Zipper Head Actively Integrating the Socket Box A perspective view of the present zipper, in accordance with the invention, is illustrated in FIGS. 3A–B, showing two methods of how zipper head 22Z actively integrates and couples box 36. This couples and arrests the movement of head 22Z, box 36 and the female side of the zipper system and aligns the members to provide an immobile and aligned entrance for coupling.

FIG. 3A shows head 22Z with shortened extended integrating and arresting structure 22S, similar to that seen in FIGS. 1A–C. Head 22Z is equipped with integrating head panels 22N which couple with socket box 36 to arrest movement of the female members and align their entrances. When head 22Z and structure 22S are moved in a first direction to integrate box 36, as shown by the direction of the arrow, (the same as in FIGS. 1A–C and FIG. 2), head panels 22N slide into the interior of box 36 and arrest the movement of head 22Z, structure 22S and box 36. Panels 22N can also be lowered into a sandwiching position within the walls of box 36 for integrating and coupling the female members. This integration of the members of the female side of the zipper system provide a combined integrated, arrested and aligned entrance 64/36A that can be coupled from the top or laterally. The bottom of integrating structure 22S abuts the top of box 36 to provide a smooth surface inside and out, to the integrated and coupled members. Snug bump 46, located on head panels 22N interact with recess 48 in box 36 to further integrate, couple and arrest the movement the members during coupling.

FIG. 3B shows head 22Z with shortened extended integrating and coupling structure 22S, similar to that seen in FIGS. 3A–B. Head 22Z is equipped with integrating head plugs 22P (plugs coming from head 22Z) which integrate with box 36 to arrest movement and align the entrances. When head 22Z and structure 22S are moved in a first direction to the initiating edge of the zipper to integrate and couple head 22Z with box 36, as shown by the direction of the arrow, (the same as in FIGS. 1A–C, FIG. 2, and FIG. 3A), head plugs 22P slide into socket member voids or sockets 36S in the walls of box 36 and arrest the movement of head 22Z, structure 22S and box 36. The coupling of the members of the female side of the zipper system provide a combined integrated, arrested and aligned entrance 64/36A that can be coupled from the top or laterally. The bottom of integrating structure 22S abuts the top of box 36 to provide a smooth surface inside and out, to the coupled members. (Note, that all plugs 22P and head sockets 36S are not numbered to provide a clear illustration.)

Figure 4A:
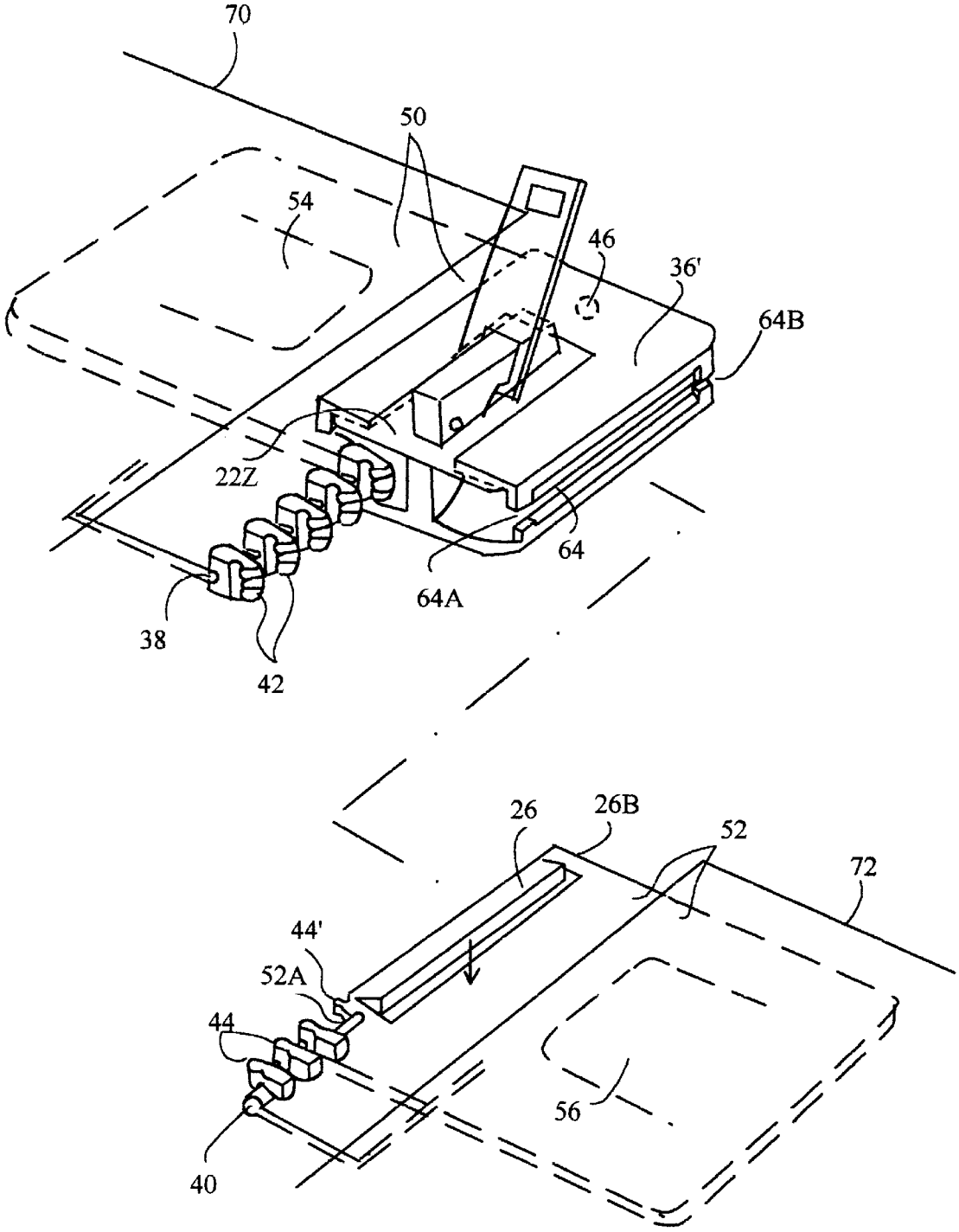
FIGS. 4A is perspective view of a fourth embodiment, according to my invention.
Figure 4B:
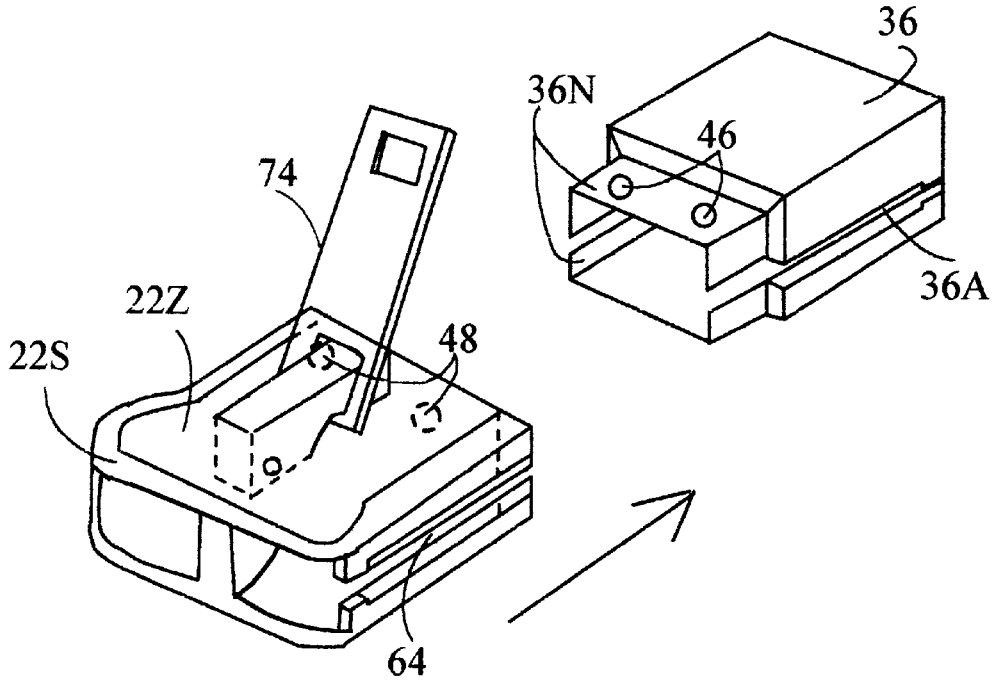
FIG. 4B is a perspective view of a modification of the forth embodiment.
Figure 4C:
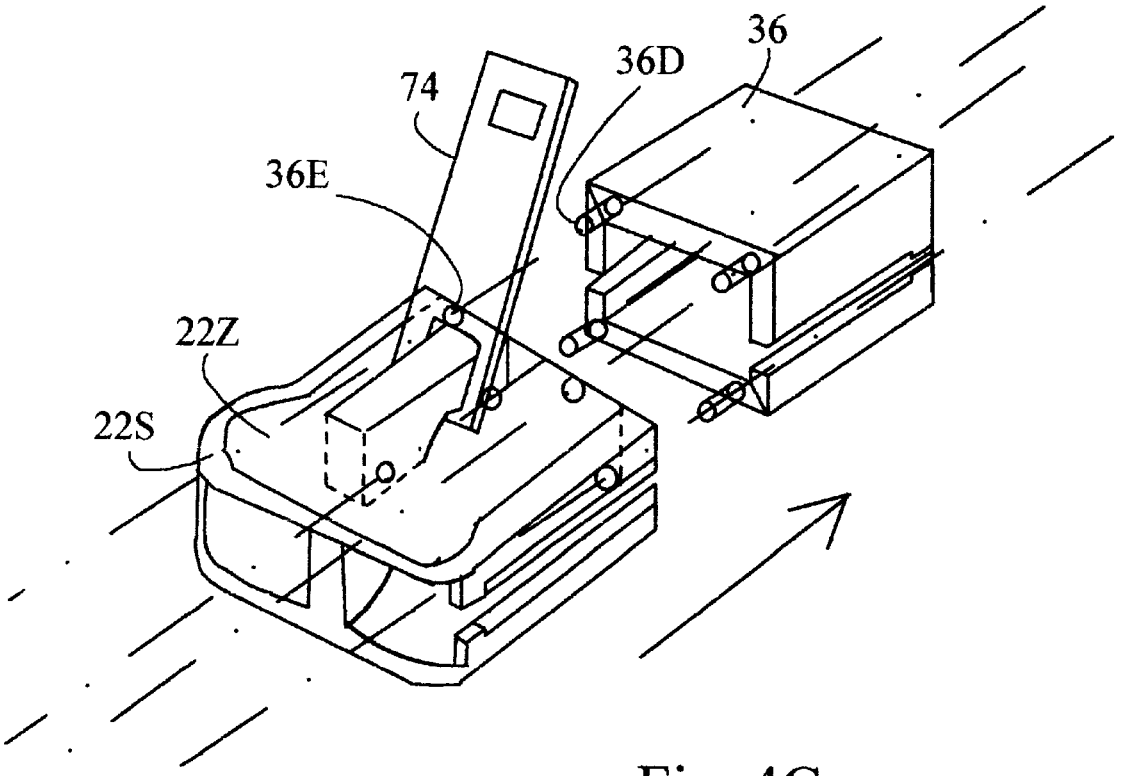
FIG. 4C is a perspective view of second modification of the forth embodiment.

FIGS. 4A–C–Description and Operation of the Fourth Embodiment—Three Illustrations of the Socket Box Actively Coupling the Sliding Zipper Head Which Mates with a Resilient Male Interlocking Pin A perspective view of the present zipper, in accordance with the invention, is illustrated in FIGS. 4A–C, showing three methods of how a socket member actively couples the sliding zipper head 22Z (as opposed to the zipper head coupling the socket member) to integrate, couple, align and arrest the movement of the female side of the zipper system to provide a unified entrance for coupling with the male side of the zipper.

FIG. 4A shows an integrated zipper system very similar to the integrating structure of FIGS. 1A–C, however the extending integrating structure is attached to box 36. In this fourth embodiment, box 36 is molded (or other wise provided with) with extending integrating structure that extends beyond and above box 36, hereafter called assembly 36'. Assembly 36' can encompass zipper head 22Z to arrest the movement of and couple the female members of the zipper. Assembly 36' is equipped with a laterally guiding and compressing framework or tapered entrance 64S on its separable side, similar to the entrance in FIGS. 1A–C. Entrance 64S has the same upper opening 64A and lower opening 64B to allow coupling slider 22 to slide and to allow edge 52A to pass through, above entrance 64, aligning coupling element 38 with element 40.

Head 22Z is pulled by pull 74 in a first direction to the initiating end of coupling element 38 where it slides into assembly 36', coupling and temporarily arresting its movement for coupling with the male side of the zipper. The top of head 22Z is indented along the edges (or where needed) to provide a flush surface to assembly 36' when integrated. Interacting snug bump (s) 46 and recess 48 as well as tongue and groove 45, 45' respectively are used to properly integrate assembly 36' with head 22IZ. Pin 26 is laterally pushed into entrance 64', aligning partial teeth 42' and 44' and protrusion 24A with recess 26A. Head 22Z is then drawn in a second direction coupling elongated coupling elements 38 and 40 along their length. Assembly 36' remains at the initiating edge of coupling element 38. Intergarment plates 50 and 52 are used the same in the fourth embodiment as they are in the first. Pin 26 is uncoupled from the top.

FIG. 4B shows head 22Z having a shortened extended integrating and coupling structure 22S, similar to that seen in FIGS. 1A–C. Box 36 is equipped with integrating socket panels 36N which integrate with and couple head 22Z to arrest movement and align the entrances. When head 22Z and structure 22S is moved in a first direction to couple box 36, as shown by the direction of the arrow, (the same as in FIGS. 3A), socket panels 36N slide into the interior of head 22Z and arrest the movement of head 22Z, structure 22S and box 36. This integration of the members of the female side of the zipper system provide a combined coupled, arrested and aligned entrance 64/36A that can be coupled from the top or laterally. The bottom end of head 22Z and the top edge of box 36 abut each other to provide a smooth surface inside and out, to the coupled members. Snug bumps 46, located on socket panels 36N interact with recesses 48 in head 22Z to further integrate and arrest the movement the members during coupling.

FIG. 4C shows head 22Z with shortened extended integrating and coupling structure 22S, similar to that seen in FIGS. 3A–B and 4B. Box 36 is equipped with integrating socket plugs 36P (plugs coming from box 36) which integrate with head 22Z to arrest movement and align the entrances. When head 22Z and structure 22S are moved in a first direction to the initiating edge of the zipper to couple box 36, as shown by the direction of the arrow, and FIG. 3A), socket plugs 36P slide into zipper head voids or sockets 22V in the walls of head 22Z and arrest the movement of head 22Z, structure 22S and box 36. This integration of the members of the female side of the zipper system provide a combined coupled, arrested and aligned entrance 64136A that can be coupled from the top or laterally. The bottom of integrating structure 22S abuts the top of box 36 to provide a smooth surface inside and out, to the integrated members. (Note, all plugs 36P and head sockets 22V are not numbered to provide a clear illustration.)

Figure 5:
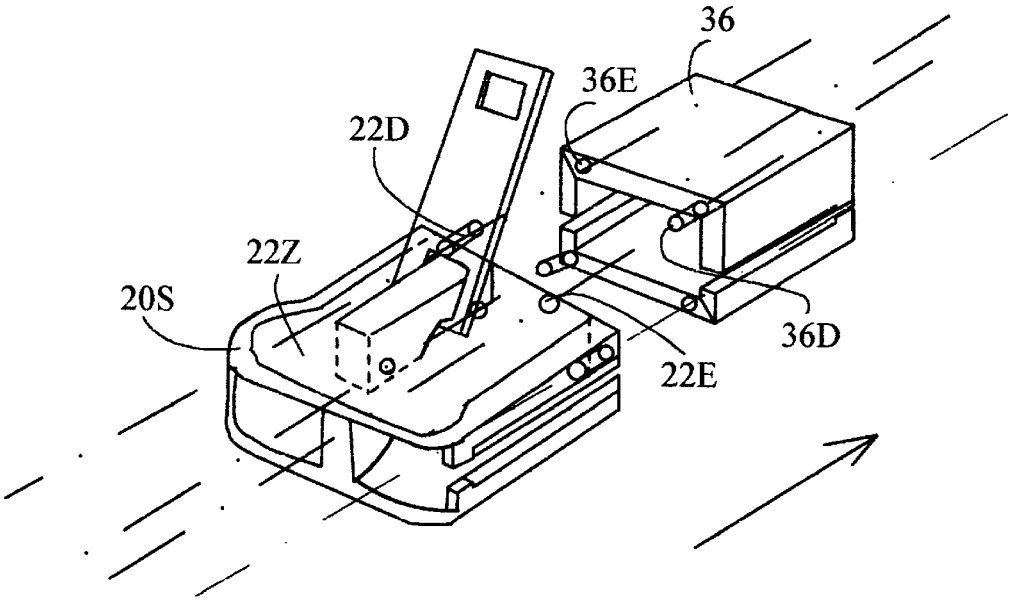
FIG. 5 is a perspective view of a fifth embodiment, according to my invention.

FIG. 5—Description and Operation of the Fifth Embodiment—Simultaneous Integration and Coupling of the Female Members A perspective view of the present zipper, in accordance with the invention, is illustrated in FIG. 5. FIG. 5 shows integrating structure coming from both the zipper head and the socket member as opposed to the integrating structure coming from one or the other. FIG. 5 shows head 22Z with shortened extended integrating and coupling structure 22S, similar to that seen in FIGS. 3A–B and 4B–C. Head 22Z is provided with two integrating head plugs 22P and two head sockets 22V that correspondingly and simultaneously integrate with two socket member plugs 36P and two socket member voids 36S when head 22Z and structure 22S are drawn in a first direction to the initiating end of coupling element 38. As head 22Z and structure 22S are moved down to box 36, plugs 22P reach down to insert into voids 36S in box 36 and plugs 36P reach up into voids 22V in head 22Z, simultaneously integrating and coupling the two female members and providing an arrested, coupled and immobilized entrance 63136A that can be coupled from the side or the top.

Figure 6:
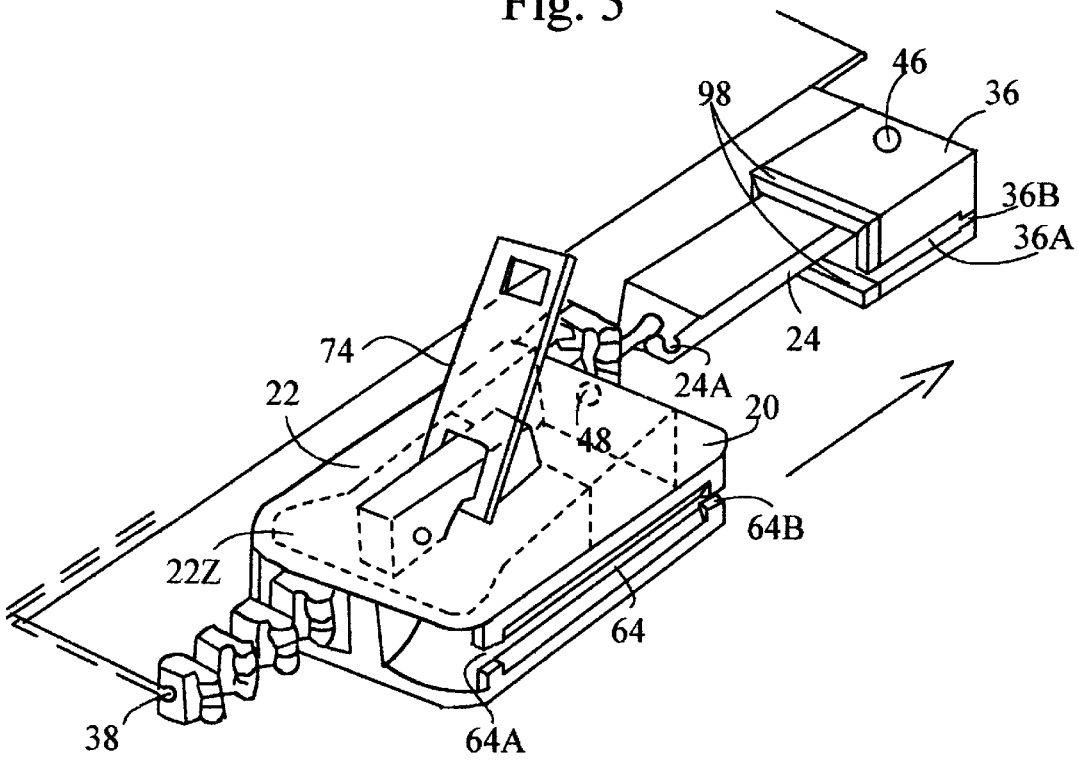
FIG. 6 is a perspective view of a portion of FIG. 1A, showing a modification of the interacting structure shown in FIG. 1A.

FIG. 6—Description of Magnetic Interacting Structure to Further Integrate the Members of the Female Side of the Zipper A perspective view of the present zipper using a magnet to integrate and couple the female members, in accordance with the invention, is illustrated in FIG. 6. Box 36 has a magnet 98 implanted on its upper surface. Interacting magnet 98 acts to further integrate and arrest the movement of head 22Z., when assembly 22 is drawn in a first direction to coupling element 38, encompassing box 36. When head 22Z is lowered, and box 36 is encompassed (or close to head 22Z), the magnetic force of magnet 98 reaches up, attracts and temporarily holds head 22Z that is constructed of iron or other magnetically attracted metal, coupling and further immobilizing the members on the female side of the zipper system, during coupling.

FIG. 7—Description and Operation of the Sixth Embodiment—Integrated, Two-Way Zipper Mated with a Resilient Male Interlocking Pin FIG. 7 is a perspective view of a sixth embodiment having a two-way zipper head 22ZA, positioned below head 22Z, and slidably connected to coupling element 38. A two-way zipper is commonly used in work clothes, ski jackets, and other sports clothes. A two-way zipper allows the user to unzip a garment or article from the bottom up, in order to reach something in an inner garment without unzipping the whole jacket or garment.

Head 22Z is molded with (or has by other method) a two-way extended integrating and coupling structure 23', which extends beyond and below head 22Z (or similar device). The combination of extended integrating and arresting structure 23' and zipper head 23Z, becomes and defines an integrating coupling slider 23 that can encompass a second sliding zipper head or two-way zipper head 23Z, hereafter called coupling slider 23. Coupling slider 23 is slidably connected to coupling element 38 which couples and arrests the movement of head 23Z when coupling slider 23 is drawn in a first direction to the initiating end of coupling element 38, encompassing head 23Z.

Head 23Z, slidably connected to coupling element 38, is situated below head 22Z on element 38. A pin abutment 26D is located on pin 26 which fits in and interacts with a shallow recess 24D of the same per portion on pin 24. This interaction prevents pin 26 from dropping further into head 22Z and coupling slider 22 on a vertical plane than it should, and from protruding out of coupling slider 23, as there is no socket member with a restricting bottom in this embodiment, to keep it within. Abutment 26D also aids in proper alignment of coupling elements 38 and 40. A stationary pin bulge 24C (or similar restriction) keeps zipper head 23Z from sliding off stationary pin 24 when the coupling elements are uncoupled. Intergarment plates 50 and 52 penetrate the center and fortify the initial teeth on coupling elements 38 and 40. Fortified intergarment edge 52A, incorporating initial zipper teeth and element 40, fits through upper opening 64A in entrance 64. This strengthens, fortifies and aligns the beginning of coupling element 40, so resilient pin 26 snaps in easily, time after time. The fortified initial zipper teeth also aid in supporting the coupling elements and keep them in the same plane for the closure stroke of the zipper. A zipper pull 74A is located on head 23Z and rests in a recessed position which allows coupling slider 23 (with head 22Z in its upper end or elsewhere) to encompasses and couple head 23Z.

FIG. 7—Operation of the Integrated, Two-Way Zipper Mated with a Resilient Male Interlocking Pin To operate the integrated, two-way zipper of FIG. 7, head 23Z is moved in a first direction to the initiating edge of fabric 70 along element 38, to one end thereof Coupling slider 23, with head 22Z situated inside its upper end is moved in the same first direction along element 38 to encompass head 23Z at the initiating edge of fabric 70. Encompassing head 23Z by coupling slider 23 couples and arrests all movement of head 22Z, head 23Z and coupling slider 23. It also aligns the entrances of head 22Z and head 23Z for precise snapin lateral coupling with the male side of the integrated, two-way zipper system. This integrated two-way zipper can also be coupled from the top. Pull 74A is flush with head 22ZA and its unfastened end is held toward the wider end of head 22ZA to facilitate super position by coupling slider 23. When coupling slider 23 encompasses head 22Z, snug bump 46 is fitted into snug recess 48 on the underside of coupling slider 23.

The user interlocks pin 26 by placing their thumbs into recesses 54 and 56 in plates 50 and 52 and horizontally presses pin 26 into entrance 64, aligning abutment 266D with recess 24D. Pin 26 compresses in entrance 64 and resiliently snaps back when entered heads 22Z and 23Z, initially coupling the zipper. Intergarment edge 52A slides through upper opening 64A in entrance 64. Bottom edge 26B slides through lower opening 64B, which further aligns coupling element 40, and guides pin 26. Coupling element 40 and teeth 44 pass above entrance 64 and are aligned with coupling element 38 and teeth 42, placing element 40 and teeth 44 into position for intermeshing. Using pull 74, the user pulls coupling slider 23 in a second and opposite direction, intermeshing teeth 42 and 44 and coupling elements 38 and 40. Head 23Z remains at the initiating end of coupling element 38. In a second and separate movement, head 23Z is drawn in a coupling direction toward coupling slider 23, partially uncoupling elements 38 and 40 to gain access to an inner garment.

To uncouple a garment with an integrated two-way zipper, coupling slider 23 and head 23Z are drawn in a first direction until the edges of fabric 70 and 72 are reached and coupling slider 23 encompasses head 23Z, coupling and arresting all movement of the female members. Pin 26 is lifted out of coupling slider 23 in a second or coupling direction. Pin 26 can be inserted in the top to couple the two-way integrated zipper.

Figure 8A:
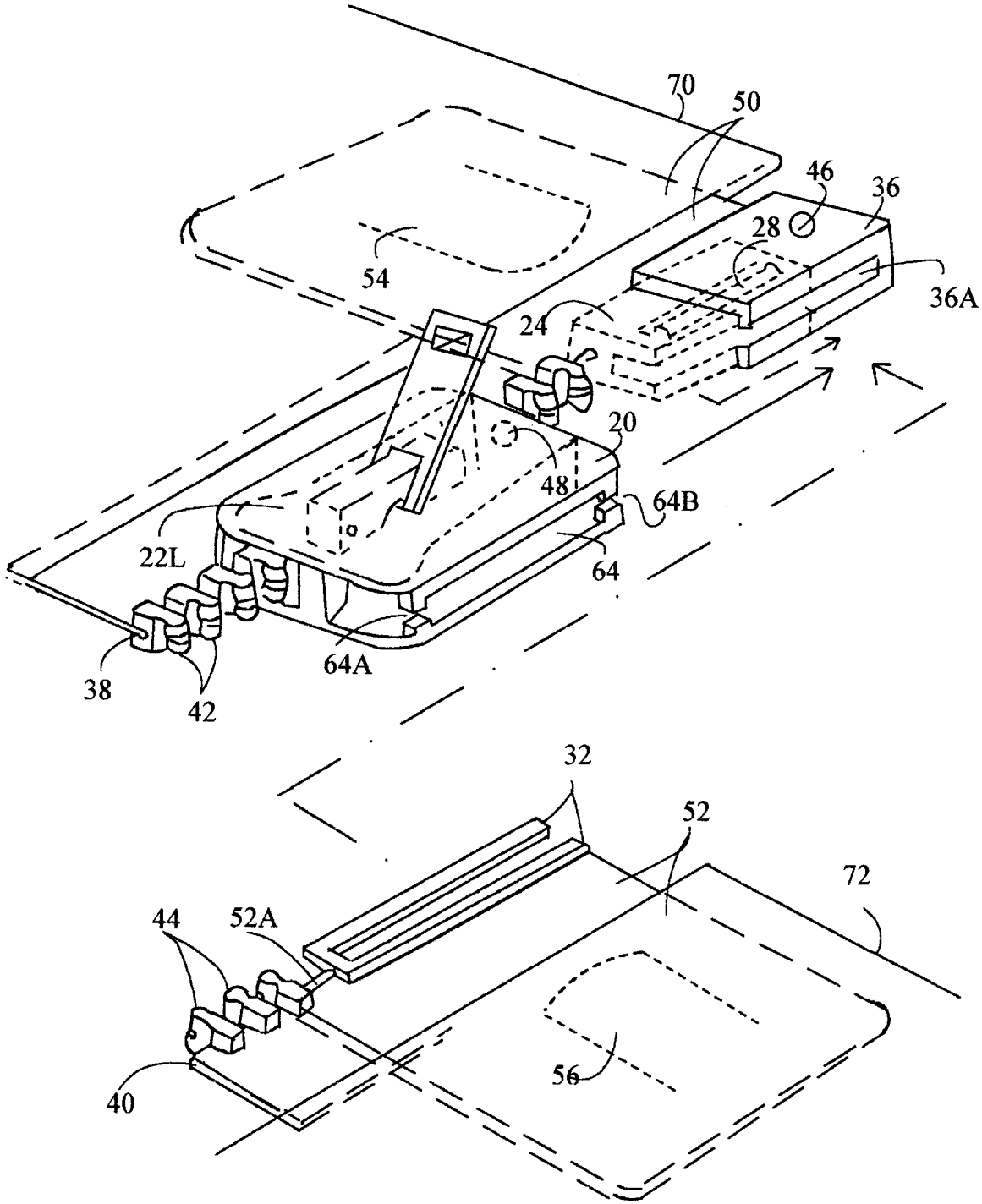
FIG. 8A is a perspective views of a seventh embodiment, according to my invention.

FIG. 8A—Description of Seventh Embodiment—Integrated, Narrow Resilient-Locking Assembly Mated with a Non-Resilient Male Interlocking Pin An seventh embodiment of the invention is discussed having a narrow resilient locking assembly and a non-resilient male pin. FIG. 8A illustrates a perspective view having a resilient-locking assembly 28 (or similar device), located in (or as a) socket box 36, as opposed to the use of a resilient pin 26 for initial coupling, as illustrated in FIGS. 1A–C, 3A–B, 4A, and 7. Resilient locking assembly 28 is equipped with a thin spring-back tab or lever of such a resilient material that springs back into its pre-compressed state after having being compressed, or a tab under which a resilient material 28A (or similar material) is positioned, such as a spring, foam, rubber, plastic, bent metal, or similar material or device. Spring 28A (or other method) is positioned under assembly 28 for the purpose of pushing assembly 28 up or resiliently deflecting assembly 28 after it has been compressed by pin 32. The heightened area of assembly 28 is designed and sized to fit and engage the vacant area or open slot of an interlocking narrow non-resilient pin 32. Pin 32 is located on and is the outermost extension of plate 52, on coupling element 40. Assembly 28 is permanently affixed in, or as member 36.

FIG. 8A—Operation of Narrow Resilient-Locking Assembly Mated with a Non-Resilient Male Interlocking Pin Coupling slider 22, with head 22Z located within its upper end, is moved by the user in a first direction along coupling element 38, encompassing, coupling and arresting all movement of box 36, head 22Z and assembly 22, forming coupled female unit 22F. Assembly 28 is permanently affixed within box 36. Assembly 28 may be constructed as a socket box itself When coupling slider 22 is drawn to the initiating edge of coupling element 38, snug bump 46 engages recess 48, and the female members are coupled to arrest the movement of the members and align their entrances. The user aligns plates 50 with 52, along the same plane, and presses pin 32 horizontally into entrance 64, where box 36 is located. The user pushes pin 32 into unit 22F and entrance 64, against the heightened and tapered area of assembly 28, compressing assembly 28, and allowing the first leg of pin 32 to move over the heightened and tapered area of assembly 28. When the first leg of pin 32 moves over the heightened and tapered area of assembly 28, assembly 28 springs back into its precompressed state, having found an open slot in pin 32. Intergarment edge 52A passes through upper opening 64A, positioning element 40 and teeth 44 above coupling slider 22, for coupling along their length The lower end of pin 32 may be tapered to a partial height of pin 32 to fit through a lower opening 64B for guiding through entrance 64, as seen by edge 26B in FIGS. 1A–C. Pin 32 is now precisely aligned next to pin 24. The user moves coupling slider 22 in a second direction, coupling elements 38 and 40 together along their length.

This embodiment is uncoupled by moving coupling slider 22 in a first direction along elements 38 and 40 until coupling slider 22 couples and encompasses box 36, arresting all movement of member 22 and box 36, forming unit 22F and can go no further. Using the opposite hand, the user removes pin 32 from box 36 and coupling slider 22 in a second direction.

Figure 8B:
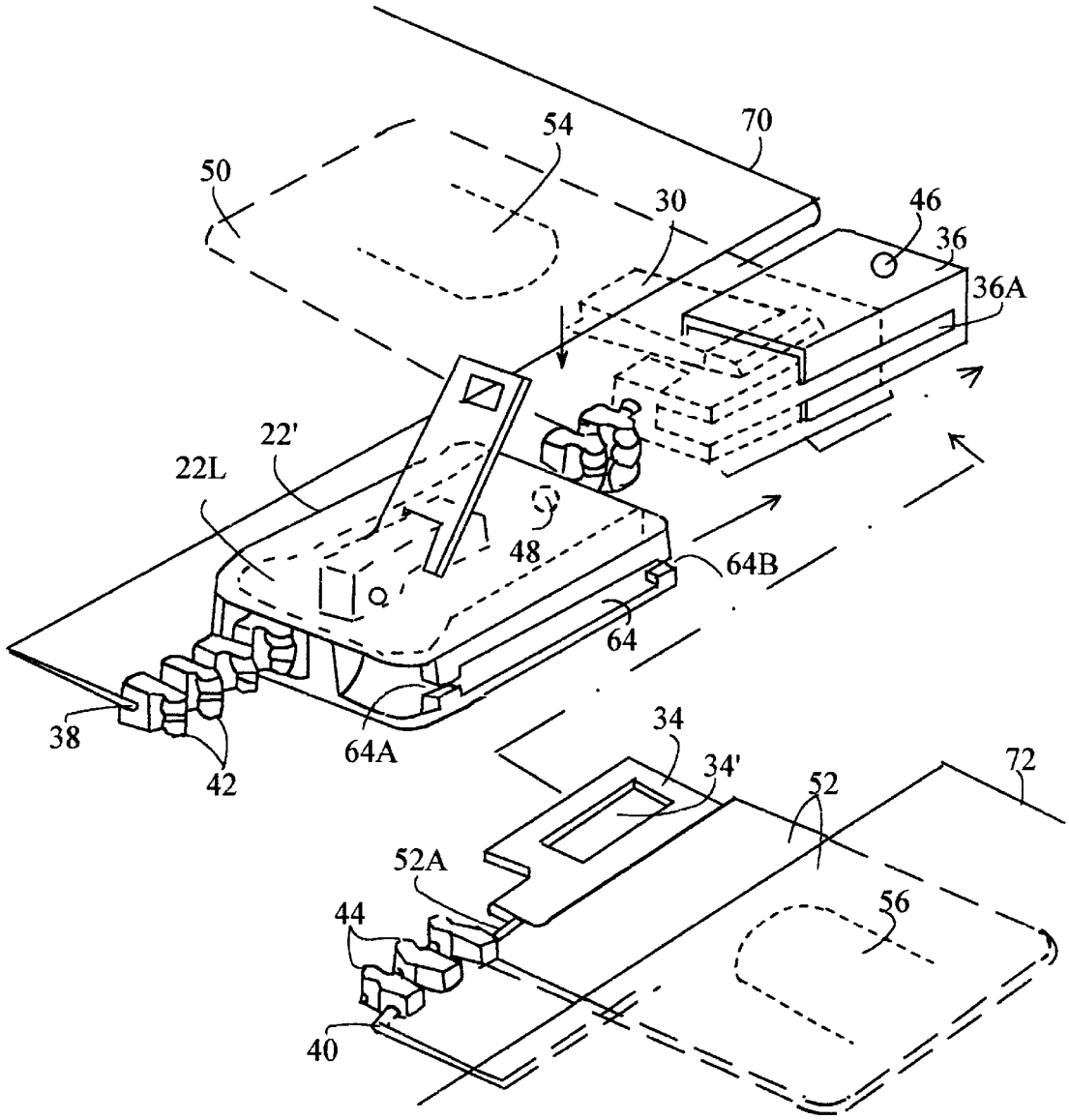
FIG. 8B is a perspective view of a modification of the seventh embodiment.

FIG. 8B—Description of a Modification of the Seventh Embodiment—Integrated, Wide Resilient-Locking Assembly Which Releases With Release Button Mated with a Non-Resilient Male Interlocking Pin A modification of a seventh embodiment showing a wide resilient-locking assembly and a non-resilient male pin with a void is discussed. FIG. 8B is a perspective view, illustrating an embodiment similar to the one in FIG. 8A. Instead of resilient-locking assembly 28 taking up the space of one pin as in FIG. 8A, a wide resilient-locking assembly 30 in this embodiment takes up the space ordinarily used by both pins, a stationary pin and an interlocking pin. A release button 60 (FIG. 2), is used to complete the decoupling process. An interlocking non-resilient pin 34, with a void 34' or recess of a determined shape, is located on and is the outermost extension of plate 52, on coupling element 40. Assembly 30 is permanently affixed in member 36. A release button 62 is located on plate 50, box 36 or on or comes through coupling slider 22. The inside areas not taken up by assembly 30 in box 36, are tapered and formed to guide pin 34 into place over assembly 30 when pushed laterally for initial coupling.

FIG. 8B—Operation of Integrated, Wide Resilient-Locking Assembly and Non-Resilient Male Interlocking Pin This embodiment is operated by moving coupling slider 22' in a first direction along element 38 to encompass and couple box 36 and assembly 30, integrating, and arresting all movement of coupling slider 22, head 22Z, box 36, and assembly 30, forming coupled female unit 22F, for precise lateral coupling. Pin 34 is attached to and is the outermost extension of plate 52, similar to pin 32 seen in FIG. 8A. Pin 34, with void 34', is pushed into guiding entrance 64 and is pushed up against a tapered front edge of assembly 30. Pin 34 moves over assembly 30, depressing its heightened and tapered area. Assembly 30 pops up into the void 34' locking it in place. Intergarment edge 52A passes through upper opening 64A, positioning element 40 and teeth 44 above coupling slider 22, for coupling along their length. This initial coupling is very similar to the coupling of a car seat belt. After initial coupling, coupling slider 22 is lifted from the rest of unit 22F and a closure stroke of coupling slider 22, couples elements 38 and 40 along their length.

Assembly 30 is permanently affixed in member 36, and encompasses the area where both pins would ordinarily be located. Assembly 30 is similar to assembly 28 in FIG. 8A, but is wider and its upper and lower edges extend into plate 50 for the purpose of being compressed together by button 62, releasing pin 34. Assembly 30 encompasses the area of both pins. Pin 34 is removed from the side by compressing button 62, which compresses assembly 30, releasing pin 34, which is uncoupled laterally, in an opposite direction to its coupling.

When decoupling the zipper, the user moves coupling slider 22 in a first direction to the end of elements 38 and 40, encompassing and coupling member 36, integrating and arresting all movement of the members of the female side of the zipper. The user presses button 62, positioned on plate 50, box 36 or on coupling slider 22. When button 62 is pressed, the heightened area of assembly 30 is compressed, allowing room for pin 34 to be removed horizontally back over assembly 30 through entrances 36A and 64, decoupling elements 38 and 40.

Figure 8C:
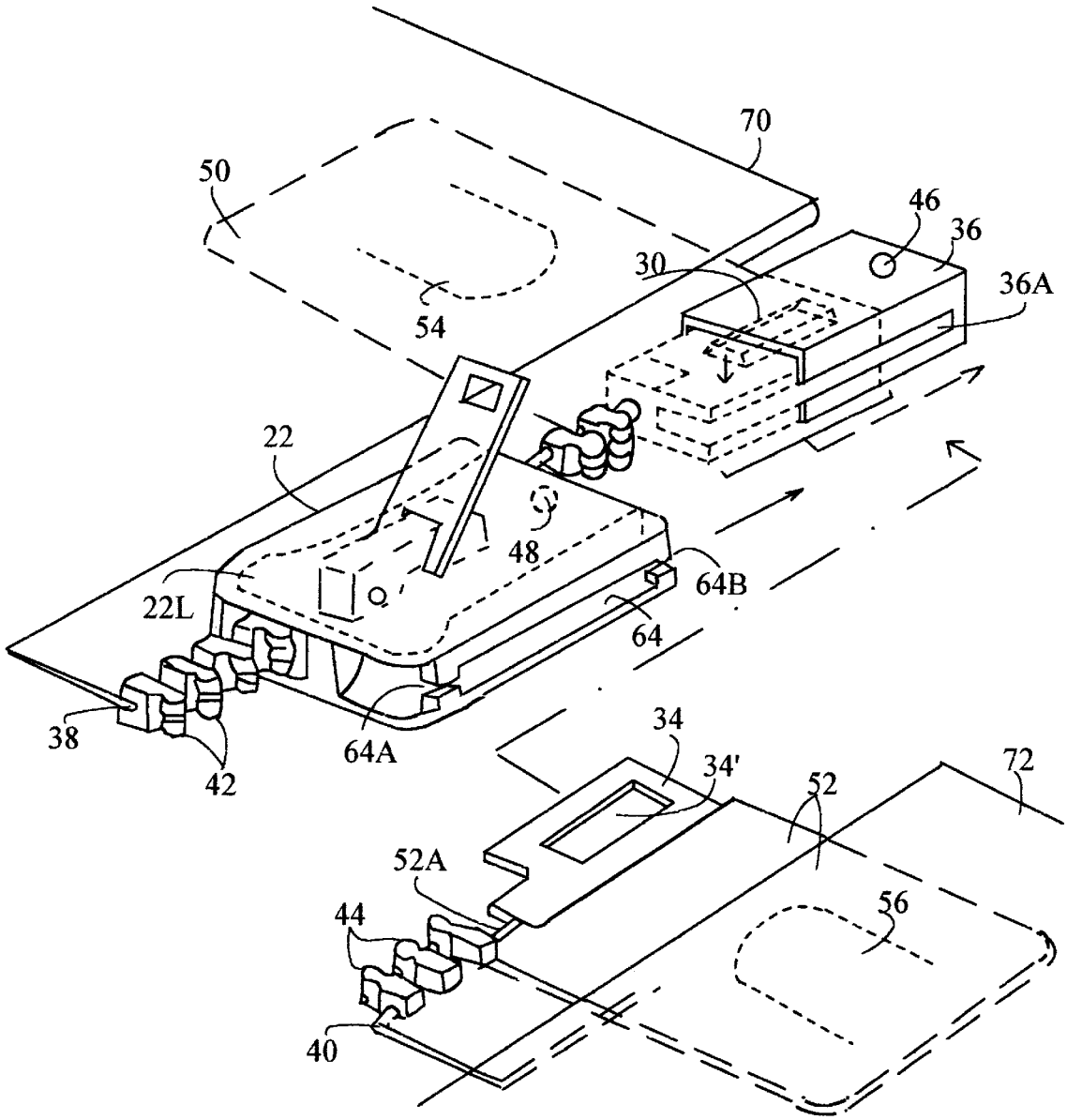
FIG. 8C is a perspective view of a second modification of the seventh embodiment.

FIG. 8C—Description of a Modification of the Seventh Embodiment—Integrated, Wide Resilient Locking Assembly Which Releases Without Release Button Mated with a Non-Resilient Male Pin FIG. 8C is a perspective view of another modification of the seventh embodiment of the invention is discussed having a wide resiliently-locking assembly 30 and a non-resilient male pin 34. FIG. 8C is similar to FIG. 8B in the way it couples, but it does not use a release button to uncouple the zipper. Wide resiliently locking assembly 30 has a tapered front edge and a tapered back edge. This modification is initially coupled the same way as FIG. 8B., being laterally coupled after coupling slider 22 is drawn over box 36 and assembly 30, arresting the movement and aligning the entrances of the members on the female side of the zipper. To uncouple this modification, the user pulls pin 34 out laterally in an opposite direction to its coupling. When pulled, pin 34 pushes against the back tapered edge of assembly 30, which compresses resilient-locking assembly 30. Assembly 30 recedes and allows pin 34 to move back over assembly 30, uncoupling the zipper. The amount of push needed to couple the zipper and the pull needed to uncouple the zipper is determined by the kind and tenacity of the resilient material used and the design of the tapered edges of assembly 30.

Figure 9A:
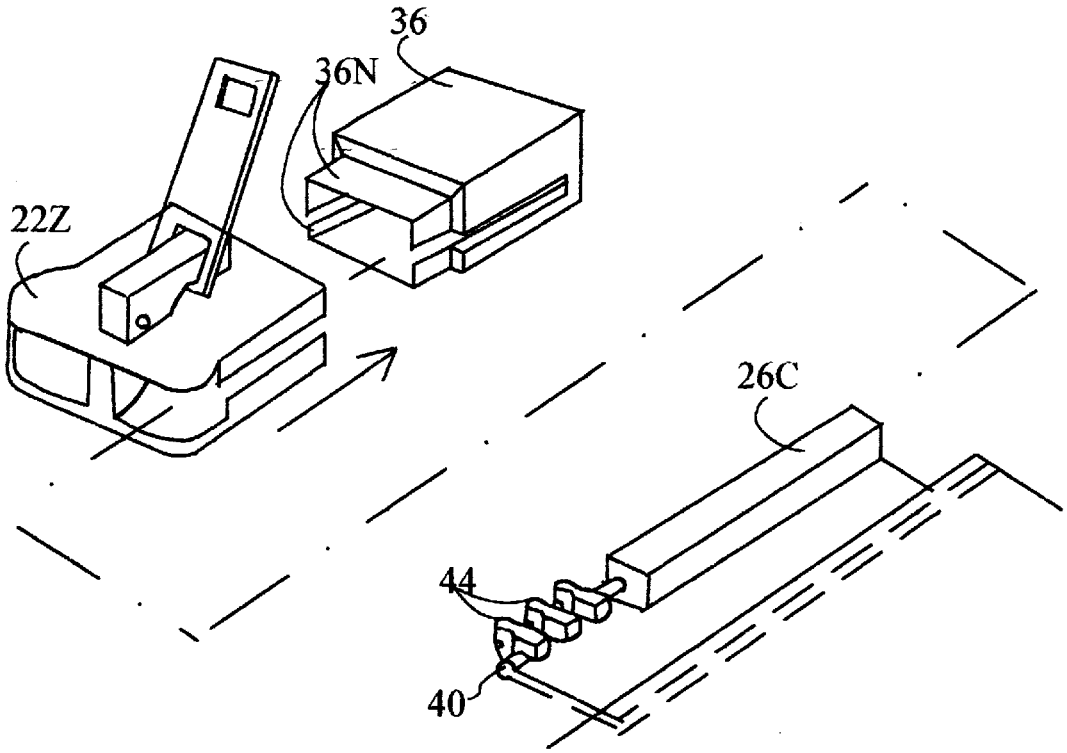
FIG. 9A is a perspective view of an eighth embodiment of a conventional-type zipper, according to my invention.
Figure 9B:
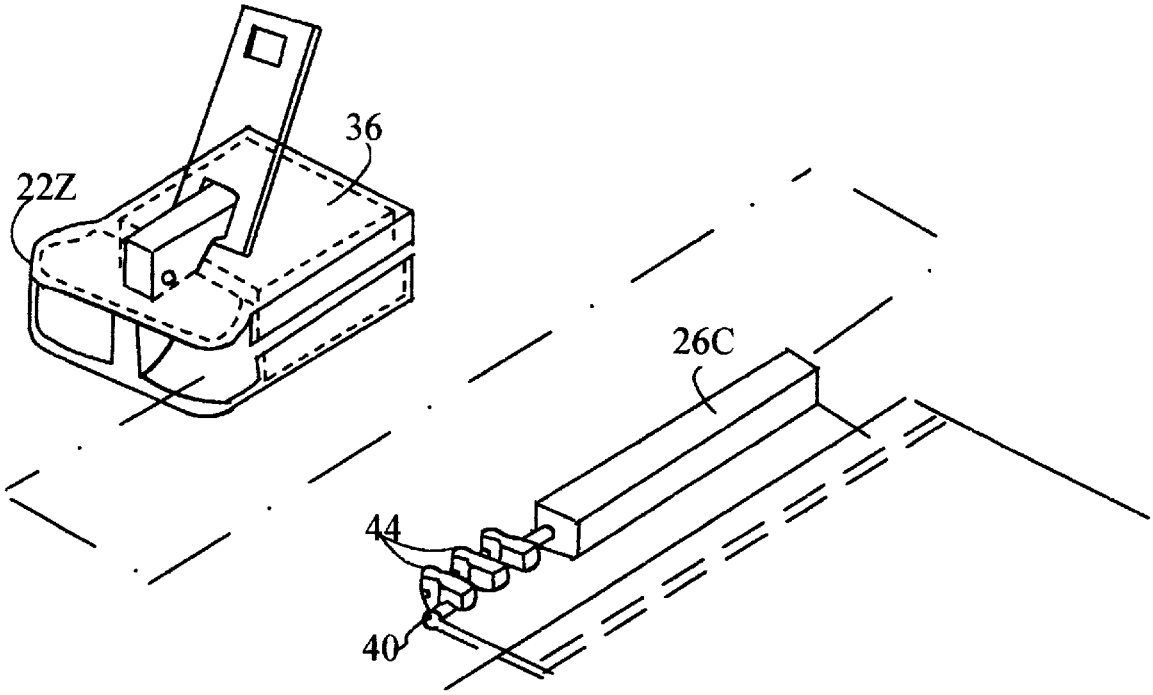
FIG. 9B is a perspective view of a modification of the eighth embodiment.

FIGS. 9A–B—Description and Operation of the Eighth Embodiment—Two Illustrations of the Integrated Zipper System on a Conventional Zipper Coupled With a Non-Resilient Pin A perspective view of the present integrated zipper, for use with a conventional zipper, one that is coupled from the top, according to my invention, is illustrated in FIGS. 9A–B. FIG. 9A shows head 22Z to be lowered in a first direction, as seen by the direction of the arrow, over integrating panels 22N, extending from box 36. Head 22Z integrates and couples with box 36 and engages snug bumps 46 with recesses 48, arresting the movement of head 22 and box 36, and aligns their entrances. A conventional male interlocking pin 26C is then inserted into the coupled members for trouble free coupling from the top. Head 22Z and box 36 have complimentary structure and provide a smooth interior for the coupling of pin 26C. Integrating structure may also come from head 22Z (as seen in FIGS. 3A–B), from box 36 (as seen in FIGS. 4A–C) or from both head 22Z and box 36, (as seen in FIG. 5) to couple and arrest the movement of the members and align their entrances for precise coupling.

FIG. 9B, a modification of the eighth embodiment of the integrated zipper system used in a conventional zipper is discussed. FIG. 9B shows box 36 integrated and coupled within head 22Z, to arrest the movement of the female members and to align their entrances. Head 22Z has recessed walls and complimentary structure to encompass box 36 to provide a smooth interior chamber for coupling with pin 26C from the top. Head 22Z remains at the initiating end of coupling element 38 when head 22Z is drawn in a second direction coupling the zipper. Uncoupling is from the top in a conventional manner.

Figure 10:
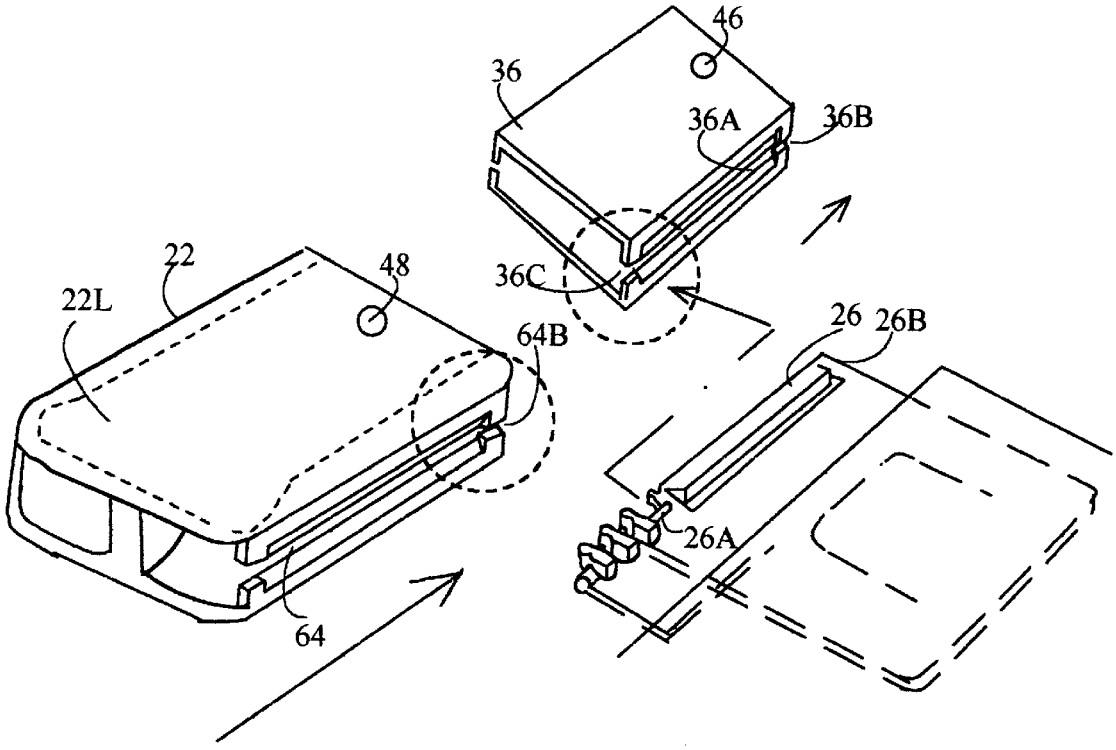
FIG. 10 is a perspective view of an automatic aligning method, according to my invention.

FIG. 10—Description and Operation of an Automatic Aligning Method

FIG. 10 is a perspective view illustrating an automatic aligning method used to force coupling slider 22 all the way down on coupling element 38, should coupling slider 22 not be all the way down on element 38 before coupling. FIG. 10 shows coupling slider 22 coupling box 36 by encompassing box 36, a first movement shown by the direction of the long straight arrow. Box 36 is full length and fits within the full length of coupling slider 22 up to (or surrounding) its dividing triangle 22T. This aligns entrances 36A and 64, and engages interacting structure 46 with 48. If coupling slider 22 is not pushed all the way down, this can be rectified during coupling. Pin 26 when laterally pushed into the almost aligned entrances 36A and 64, passes through entrance 64, in and under the top tapered edge of entrance 36A, (a second movement shown by the direction of the broken arrow). Entrance 36A is part of an immobile box 36. Pin 26 pushes under the immobile top edge of 36A. Pin 26 moves to find an entrance wide enough to enter and in turn cannot push the immobile entrance 36A so it pushes against the lower mobile edge of entrance 64, (64B), forcing coupling slider 22 all the way down on coupling element 38, widening the entrance for perfect snap-in coupling, (third and last movement [of the aligning method] as shown by the direction of the shortest arrow). When pin 26 is pushed into head 22Z and box 36, it also engages partial tooth 44' with partial tooth 42' and protrusion 24A with recess 26A. Fitting these male and female interacting structures together will also force coupling slider 22 all the way down on coupling element 38 if box 36 does not have a full entrance.

Figure 11A:
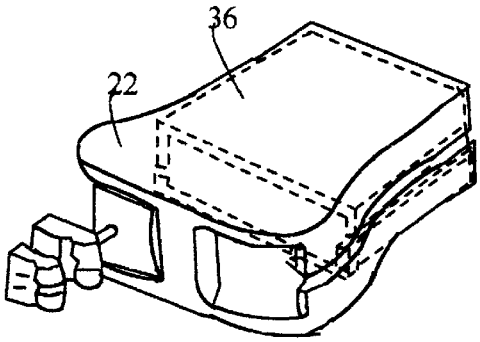
FIG. 11A is a perspective view of a sliding zipper head encompassing a socket member, according to my invention.
Figure 11B:
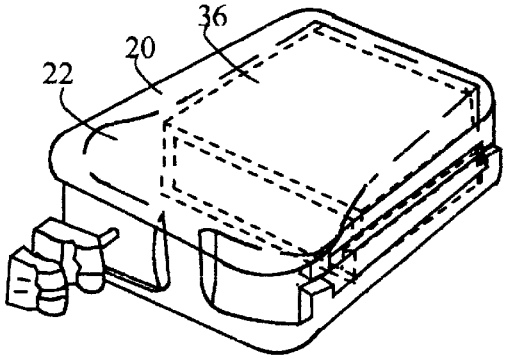
FIG. 11B is a perspective view of a sliding zipper head with extended integrating and arresting structure encompassing a socket member, according to my invention.

FIGS. 11A–B—Description of Two Methods of How Head 22Z Encompasses a Socket Box FIG. 11A is a perspective view of head 22Z illustrating how head 22Z integrates, couples and encompasses box 36 within the confines of head 22Z. Box 36 can be made in a predetermined smaller size and shape to fit and couple inside head 22Z to arrest movement of the female members and align their entrances for coupling. FIG. 11A can be coupled laterally or conventionally.

FIG. 11B is a perspective view of head 22Z as seen in FIG. 11A with the additional integrating structure 22'. Box 36 is integrated and arrested within head 22Z. Structure 22' provides a guiding lateral entrance for easy lateral coupling. FIG. 11B can be coupled laterally or conventionally.

FIGS. 12G–P—Description of Modifications of Resilient Interlocking Pins

Figure 12G:
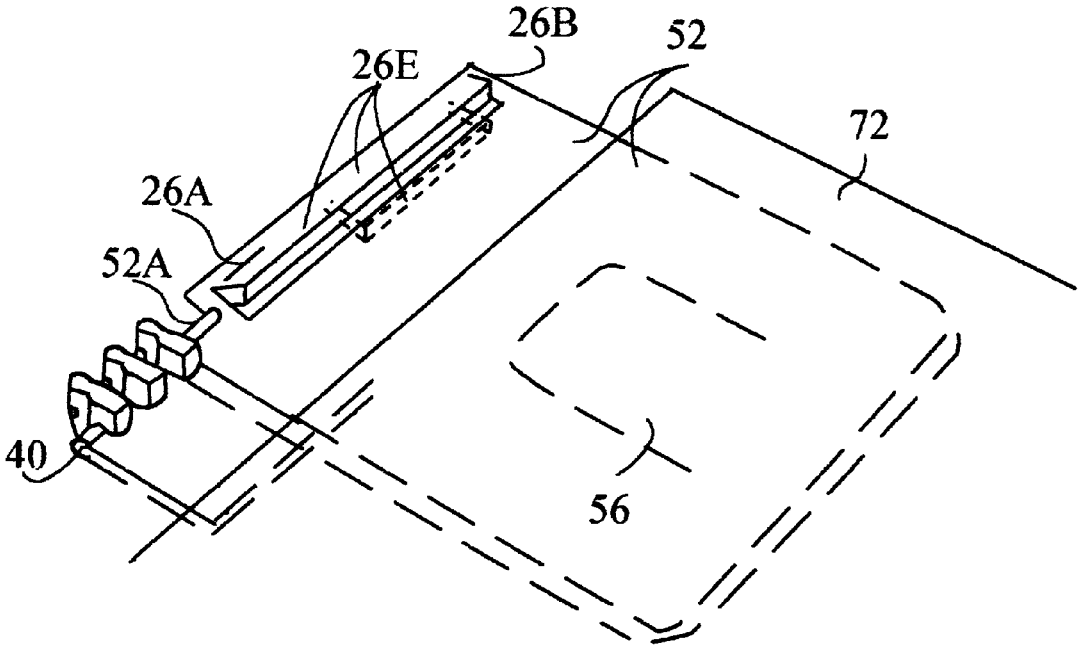
FIGS. 12G–P are perspective views of modifications of the resilient male pin illustrated in FIGS. 1A–C.

FIG. 12G is a perspective view of a resilient pin 26E, in accordance to my invention, that has a long upward flange and a short lower flange. This pin can resiliently engage head 22Z in one direction and box 36 in two directions.

Figure 12H:
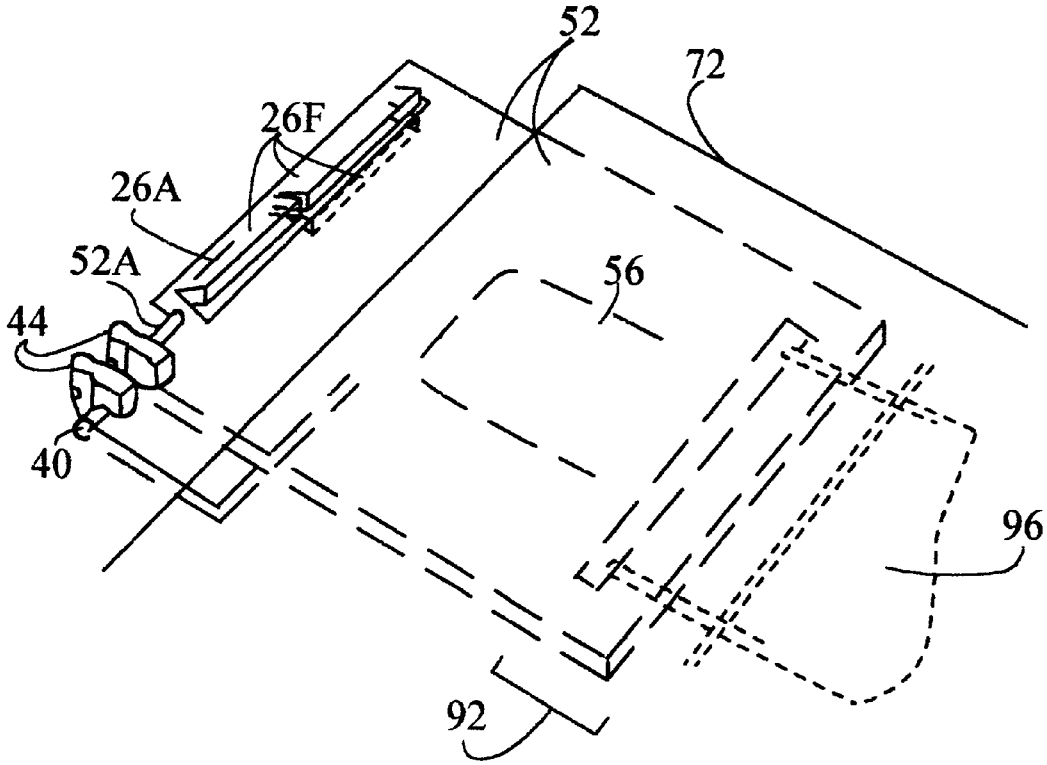

FIG. 12H is a perspective view of a resilient pin 26F, in accordance with the invention, that has two short upward resilient flanges and one short lower flange. This pin can separately engage head 22Z and box 36 when coupled within coupling slider 22. Intergarment plate 52 has a strap holder the width of plate 52 to hold elastic in the waistband of the garment.

Figure 12I:
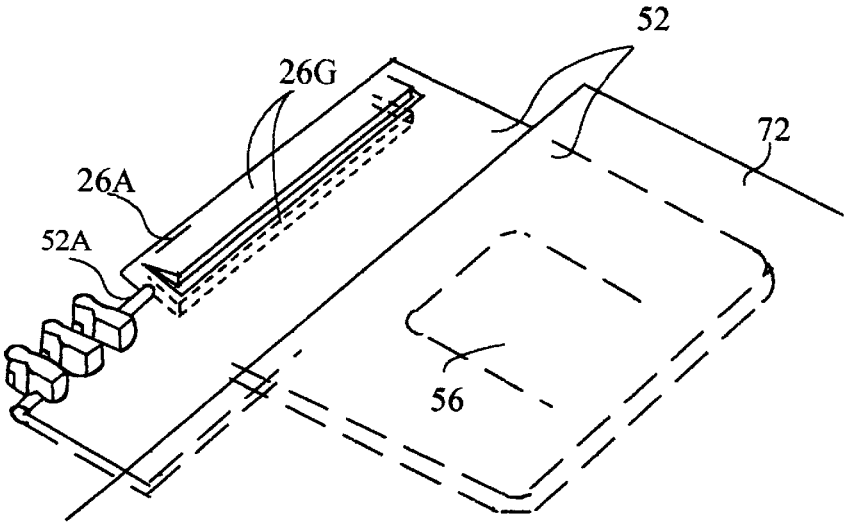

FIG. 12I is a perspective view of a resilient pin 26G, according to my invention, that has two long resilient flanges to engage both the upper and lower interlocking edges of head 22Z and box 36.

Figure 12J:
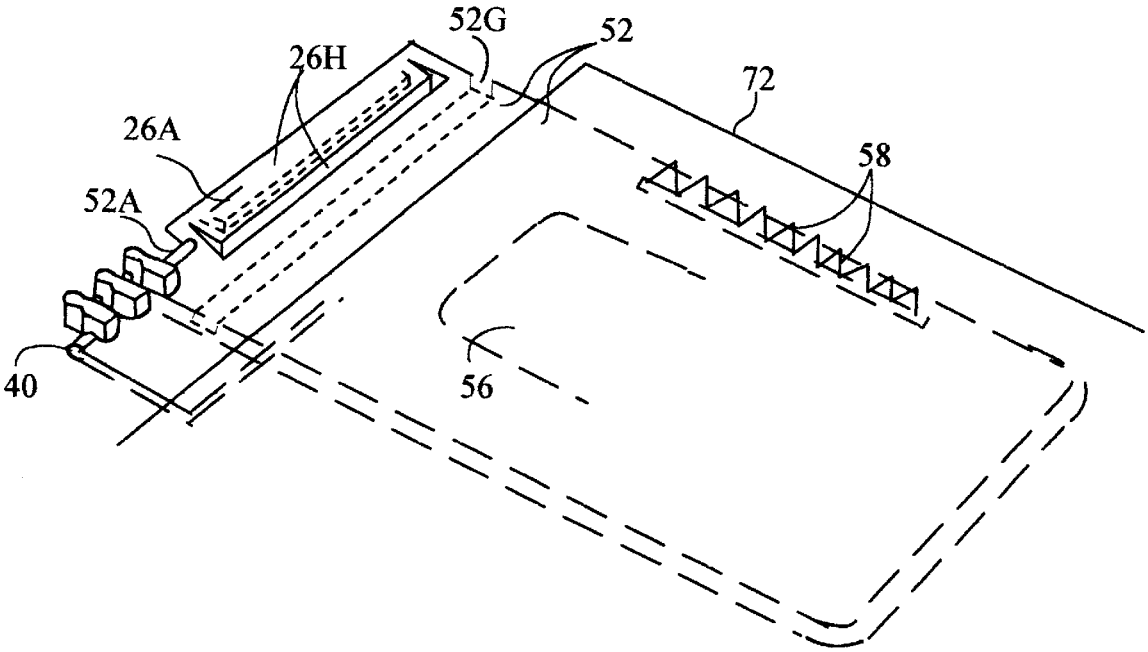

FIG. 12J is a perspective view of a resilient pin 26H, according to my invention, that has two long resilient flanges. The lower flange is slightly shorter and can nest within the upper flange when compressed (shown) to easily interlock without bulk. FIG. 12D has an elongated intergarment plate 52, showing stitching used to attach the intergarment plates to the garment. This stitching can be placed anywhere where needed. Intergarment plate 52 illustrates a grooved insert for allowing head 22Z to slide.

Figure 12K:
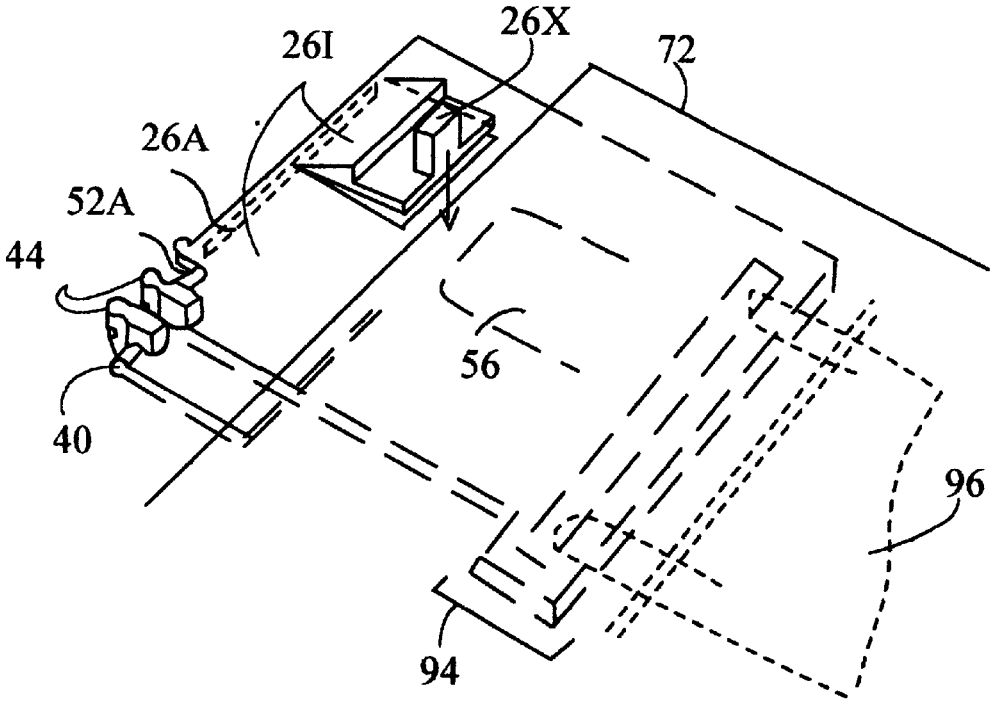

FIG. 12K is a perspective view of a pin 26I, in accordance with this invention, that is part resilient and part non-resilient, according to my invention. The upper non-resilient edge is slender and registers with head 22D. Partial tooth 44' engages partial tooth 42'. The lower resilient edge, with a release button 26X simultaneously interlocks one side of box 36. Button 26X is pushed to unlock pin 26I from coupling slider 22.

Figure 12L:
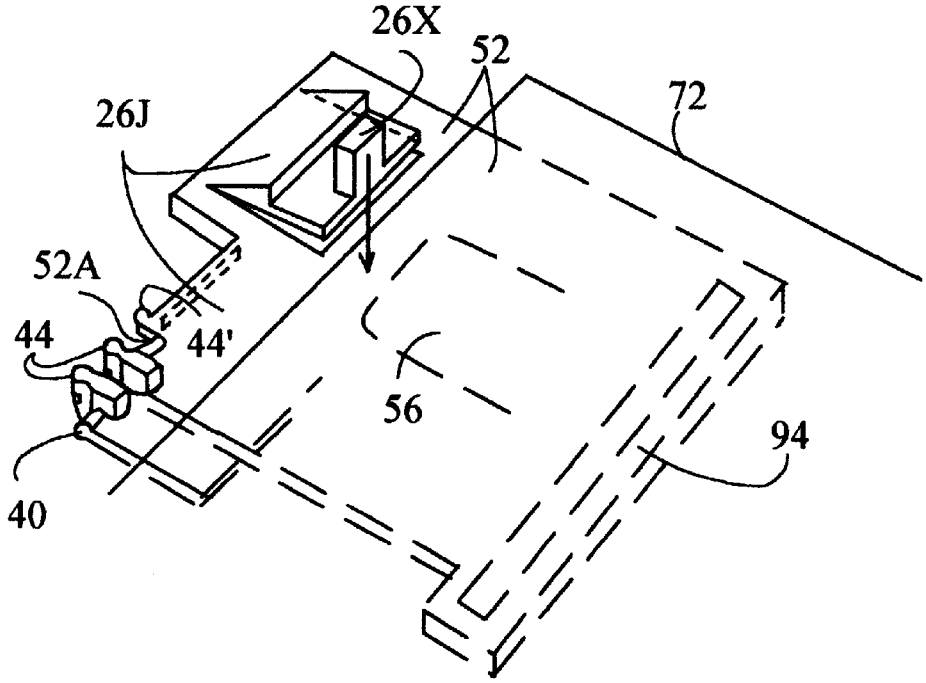

FIG. 12L is a perspective view of a pin 26J, that has a non-resilient portion on the resilient interlocking element, according to my invention. Pin 26J also has a corresponding differentiated width. The upper narrow, non-resilient edge is slender and registers with zipper head 22Z. Partial tooth 44' engages partial tooth 42'. The lower wide, resilient edge, with a release button 26X simultaneously interlocks the full width of box 36. Button 26X is depressed to unlock pin 26J from assembly 22. Pin 26J has a wide strap or elastic holder, situated on inte.rarmaent plate 52 for holding an elastic band commonly found in the waistband of jackets and sweaters.

Figure 12M:
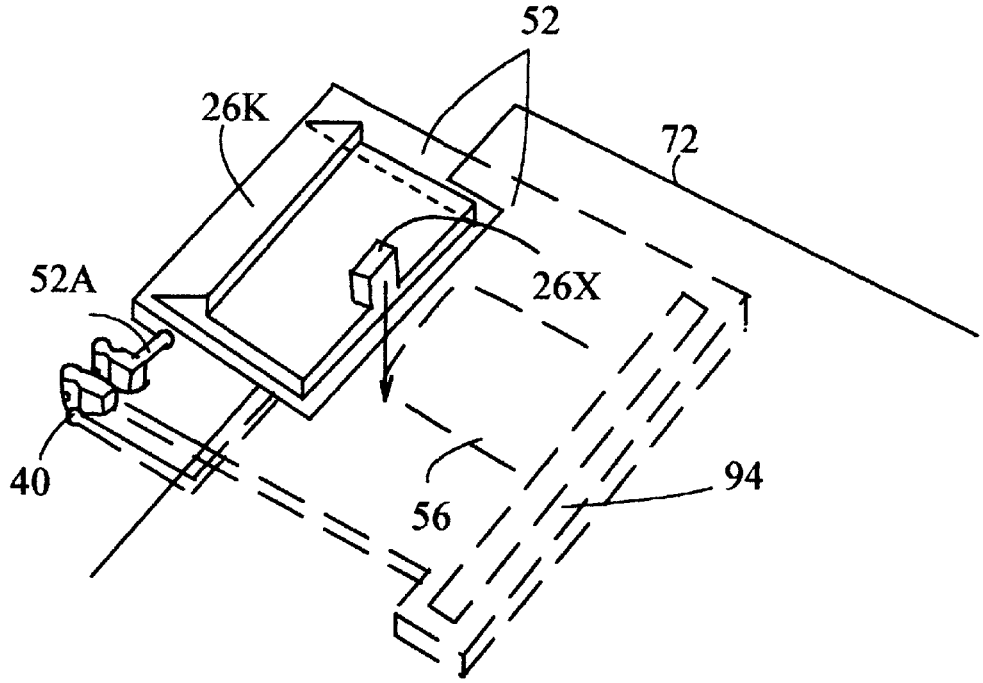

FIG. 12M is a perspective view of a resilient pin 26K, according to my invention, with an interlocking edge and a release button 26X. The resilient edge interlocks the full length of one side of head 22Z and box 36. Button 26X is pushed to unlock pin 26K from assembly 22. Button 26X is further back on intergarment plate 52. Pin 26K has a wide strap holder 92.

Figure 12N:
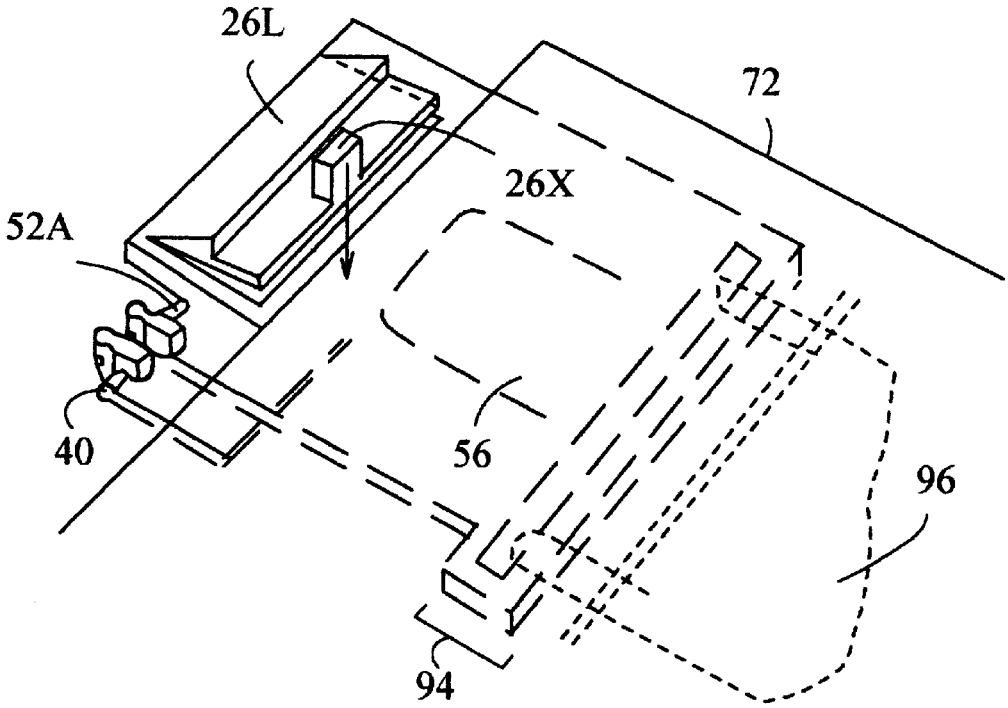

FIG. 12N is a perspective view of a resilient pin 26L, according to my invention, with a wide interlocking edge and a release button 26X. The resilient edge interlocks the full length and width of head 22Z and box 36. Button 26X is pushed to unlock pin 26L. Pin 26L has a wide strap holder.

Figure 12O:
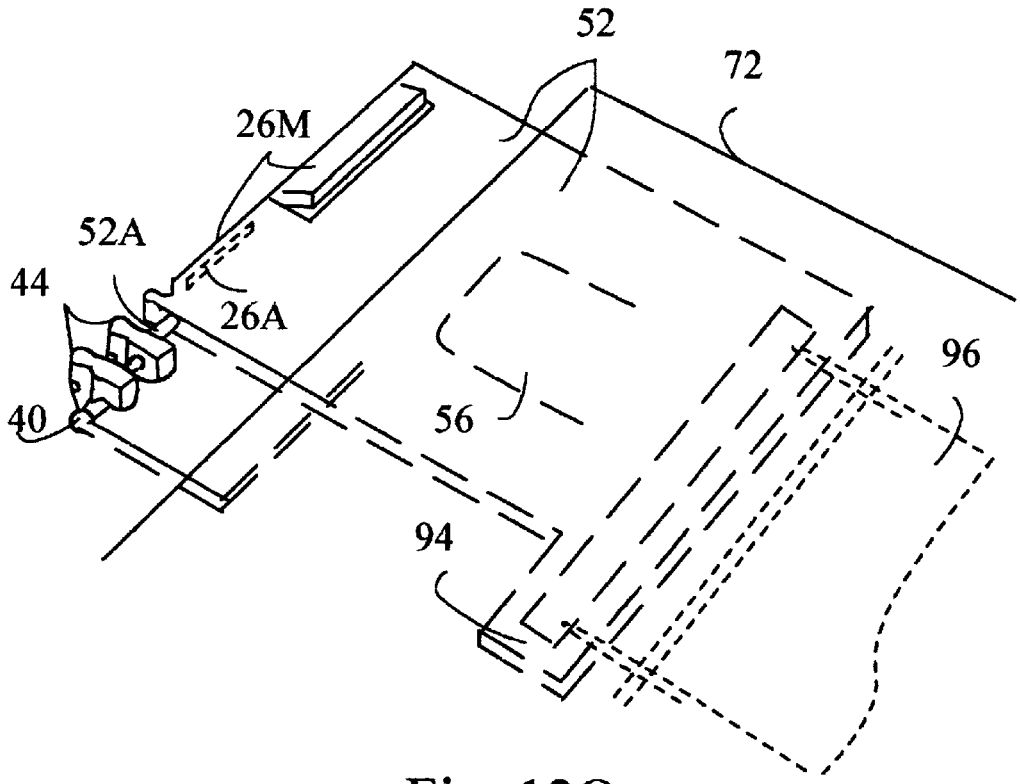

FIG. 12O is a perspective view of a resilient pin 26M, accordance to my invention, that has a non-resilient portion on resilient pin 26M. The upper non-resilient portion registers with head 22Z, and partial tooth 44' engages partial tooth 42'. The resilient portion of pin 26M has a short upward flange to interlock with box 36. Pin 26M is illustrated as having a wide strap holder and an elastic band 96.

Figure 12P:
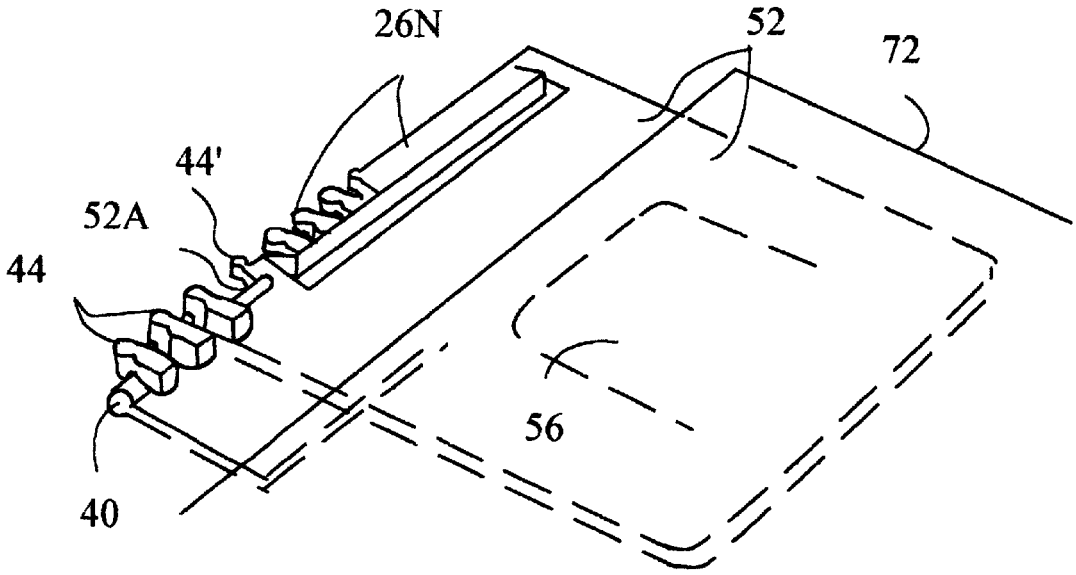

FIG. 12P is a perspective view of a resilient pin 26N, according to my invention, that has a long upward flange. The upper portion of the upward flange has engaging, partial height zipper teeth to engage with teeth (partial or whole) on coupling element 38. The lower part of the upward resilient flange is straight to interlock box 36 and register with stationary pin 24.

Figure 13C:
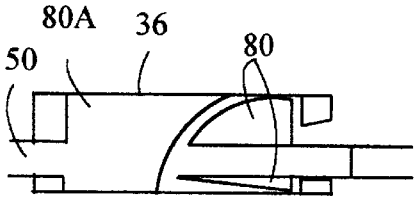
FIGS. 13–18 are cross-sections through a socket member illustrating additional modifications of the resilient male interlocking pin, illustrated in FIGS. 1A–C.
Figure 13B:
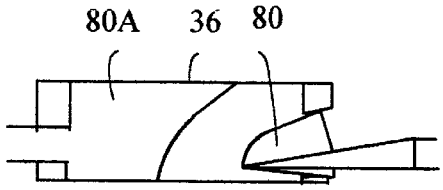
Figure 13A:
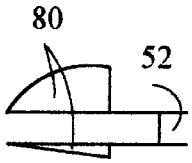

FIGS. 13–18—Description of Resilient Interlocking Pins in Cross-Sectioned Illustrations FIGS. 13A to 13C are cross-sectional views of the bottom of box 36, with the bottom removed, showing the coupling of a large top, small bottom, interlocking resilient pin 80. The top and bottom of pin 80 squeeze together as it passes through tapered entrance 64. Once through entrance 64, it regains its original shape, locking itself inside member 36. The shape of stationary pin 80A accommodates and compliments the shape of resilient spring-back pin 80, inside box 36. The opening of entrance 64 is near the bottom in this embodiment.

Figure 14C:
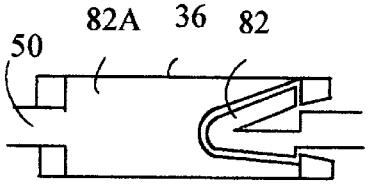
Figure 14B:
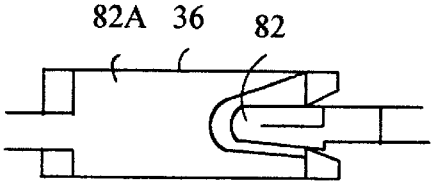
Figure 14A:
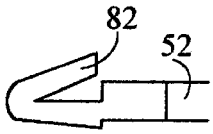

FIGS. 14A–14C—Description of Resilient Interlocking Pin With Upward Flange

FIGS. 14A–14C are three cross-sectional views of the bottom of box 36, showing the coupling of a resilient pin 82, with an upward flange and a small lower catch. The upward flange depresses and recedes into itself as it passes through tapered entrance 64. Once through entrance 64, it regains its original shape, locking itself inside member 36. The shape of stationary pin 82A accommodates and compliments the shape of resilient pin 82, inside member 36. The opening of entrance 64 is in the center in this embodiment.

Figure 15C:
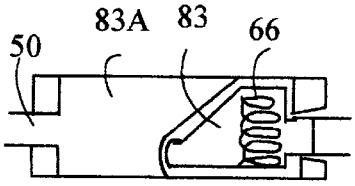
Figure 15B:
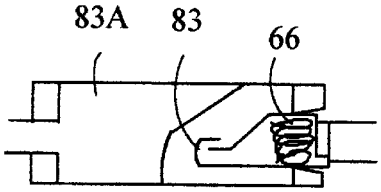
Figure 15A:
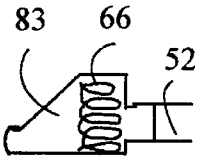

FIGS. 15A–15C—Description of Male Resilient Interlocking Pin with a Spring(s)

Shown in FIGS. 15A–C is the coupling of interlocking resilient pin 26 with a spring(s) inside. As pin 83 is pushed against entrance 64, it, the spring inside compresses and becomes planar with intergarment 52. The spring(s) inside pin 83 can be designed in a funnel or conical-shaped spiral. This funnel shaped spring(s) fits within its own rings, when compressed, allowing the spring to flatten to a single thickness of the spring and make pin 83 very slender. Once through entrance 64, pin 83 springs back and regains its original shape, locking itself inside member 36. The shape of stationary pin 24 accommodates and compliments the shape of resilient pin 83, inside member 36. The opening of entrance 64 is near the bottom in this embodiment.

Figure 16C:
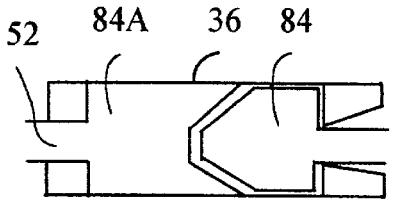
Figure 16B:
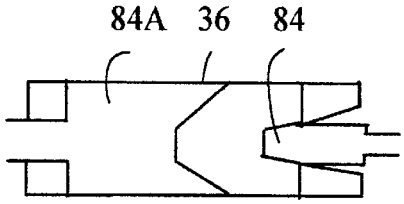
Figure 16A:
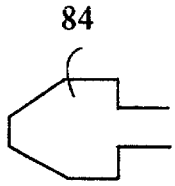

FIGS. 16A–16C—Description of Filled Resilient Pin With Resilient Material

FIGS. 16A to 16C are cross-sectional views of the bottom of box 36, showing the coupling of an interlocking resilient pin 84 with foam, rubber, or other resilient material inside. As pin 84 is pushed against entrance 64, it compresses and becomes planar with intergarment plate 52. Once through entrance 64, it regains its original shape, locking itself inside member 36. The shape of stationary pin 84A accommodates and compliments the shape of resilient pin 84, inside box 36. The opening of entrance 64 is in the center in this embodiment.

Figure 17C:
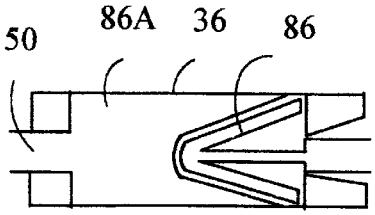
Figure 17B:
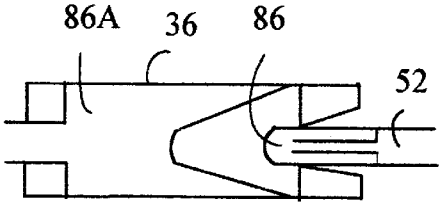
Figure 17A:
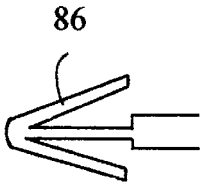

FIGS. 17A–17C—Description of Resilient Interlocking Pin Having a Center Stem and a Pair of Oppositely Deflecting Flanges In these cross-sectional views of the bottom of box 36, an interlocking resilient pin 86 is arrow (or otherwise) shaped, and made of a semi-rigid material such as plastic or metal. The top and bottom flanges of pin 86 compress against the center stem when pressed into entrance 64, becoming planar with element 52, while in entrance 64. Once through entrance 64, it regains its original shape, locking itself inside member 36. The shape of stationary pin 86A accommodates and compliments the shape of pin 86, inside box 36. The opening of entrance 64 is in the center in this embodiment.

Figure 18B:
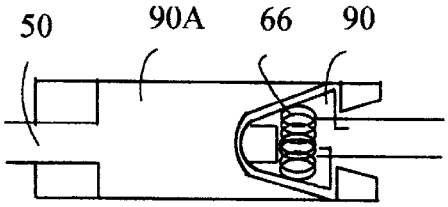
Figure 18A:
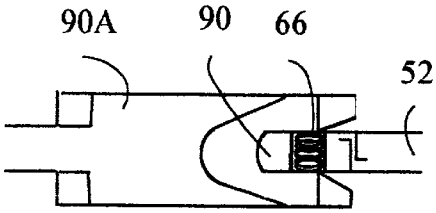

FIGS. 18A–18C—Description of Male Resilient Interlocking Pin With Supportive Framework FIGS. 18A–18C are cross-sectional views of a male resilient interlocking pin 90. Pin 90 has a strong supporting framework with a hole 90H through it. These three cross-sectional views pass behind the first leg of the framework and are illustrated cross-sectioned through the hole and in the middle of pin 90. A resilient interlocking element folds over or is part of the front of the framework. The hole in the frame contains spring 66 (or similar material), that reaches and is fastened to the underside of the top flange of pin 90. The bottom of spring 66 passes through the hole and attaches to the underside of the bottom flange of pin 90. The framework is slightly thinner than the remainder of pin 90 and element 52 so the two flanges will recede into it making pin 90 planar while passing through entrance 64. Space is made in intergarment 52 for the transience of the back panels of pin 90 when pin 90 is compressed and when pin 90 is released. Small tabs on the back panels keep the back of pin 90 within element 52 when pin 90 is expanded.

FIGS. 19A–C—Description of Interacting Structure and Retaining Mechanisms for Recessed Zipper Pull FIG. 19A is a perspective view of head 22Z, box 36 and coupling slider 22. Pull 74 has an interacting tab 74B which when lowered is inserted through a void 74B' in coupling slider 22 and into box 36. While tab 74B is inserted, coupling slider 22 cannot move and further integrates, couples, aligns and arrests the movement of the female members for coupling. While tab 74 is inserted, the top of coupling slider 22 is planar, and has a suitable surface for illustrations, especially for children.

FIG. 19B shows a pull 74 equipped with a resilient holding coil with long ends 74A. Coil 74A is placed to gently hold down tab 74 in a recessed position when not used (shown by the direction of the arrow).

FIG. 19C shows pull 74 equipped with a resiliently holding bridge 78 made of thin metal, plastic or other slim deflecting material. The base of pull 74, situated under bridge 78 acts like a lever when lifted to lift bridge 78 for use of the zipper, resiliently expanding the upper part of bridge 78. When not in use, bridge 78 recedes to its regular flat position and pulls down pull 74 into a recessed position to provide a planar surface to coupling slider 22. Interacting tab 74B (FIG. 16A) can also be used with bridge 78 to further arrest movement of the female members for coupling.

FIGS. 20A–B—Description of Planar Surface of Coupling Slider and Recessed Pull Tab FIG. 20A is a perspective view of coupling slider 22 having a planar surface and a narrow recessed pull tab 74.

FIG. 20B is a perspective view of coupling slider 22 having a planar surface and a wide recessed pull 74W. Recessed zipper pulls 74 and 74W provide a planar surface so the user is unencumbered when coupling the zipper in a "buckle-like manner". Release button 60, placed under pull 74 is activated by more strongly pushing down upon pull 74W when pull 74W is in a recessed position. Recessed pulls 74 and 74W when used with interacting structure also further arrest the movement of the female members, and provide an aesthetic surface to portray a simple operation to the user.

FIGS. 21A–E—Description of Modifications of Socket Box

FIGS. 21A–E are cross-sectional views of socket box 36, according to my invention, showing different modifications of box 36 for different applications. Also shown (FIG. 21F) is an example of how the closure system has smooth interior and exterior surfaces for efficient coupling.

Figure 21A:
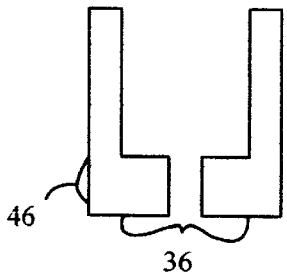

FIG. 21A is a cross-sectional view showing a half height socket box 36 (conventional height) that is used in embodiments 1–3.

Figure 21B:
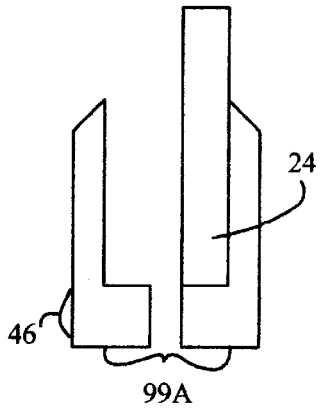

FIG. 21B is a cross-sectional view showing half-height box with a tapered top 91. The tapered top of box 91 directs the movement of coupling slider 22 to easily encompass and integrate box 91.

Figure 21C:
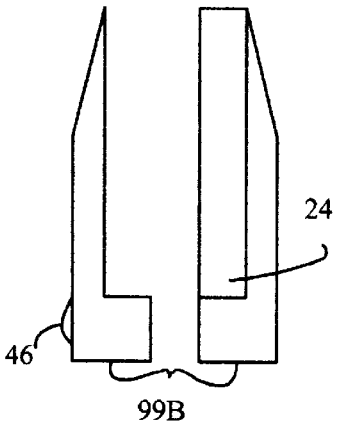

FIG. 21C is a cross-sectional view showing a half-height socket box with a long tapered top 92, that reaches to the top of stationary pin 24, for an easily guided entrance into coupling slider 22.

Figure 21D:
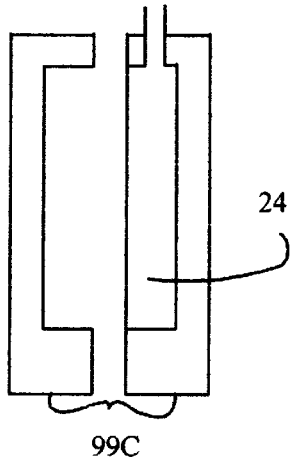

FIG. 21D is a cross-sectional view showing a full height socket box with a flat top. A full height socket box 93 provides an accessible fill entrance which can be aligned by a laterally coupling pin. (In a frontal view box 93 can be constructed with an inverted V-shaped notch going from front to back to surround the dividing triangle in head 22Z).

Figure 21E:
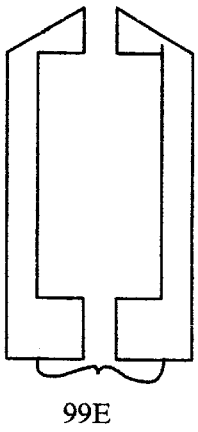

FIG. 21E is a cross-sectional view showing a full height socket box with a tapered top which can provide a fill entrance and fit higher within head 22Z.

Figure 21F:
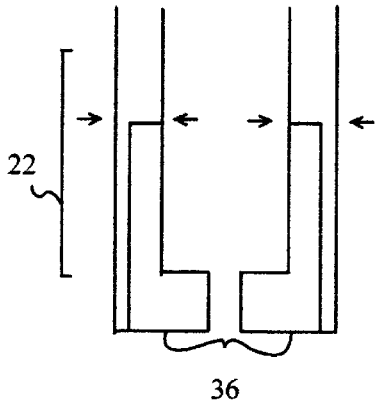

FIG. 21F is a cross-sectional view showing a lower portion of sliding socket 22 encompassing box 36, fitting over and around box 36, providing a planar or smooth interior surface and a planar exterior surface to the integrated zipper as shown by the arrows.

Summary, Ramifications, and Scope

Accordingly, the reader can visualize and will see the many advantages of the present integrated zippers. This integrated zipper system is very simple to operate and a joy to use. The integrated zipper couples, integrates, aligns and arrests all movement of the female members of the zipper, so that the user can couple the zipper as easily as they would couple a two-piece laterally coupled buckle, commonly found on belt packs, garment bags, bookbags and the like. The motions needed to operate the zipper are simple, with the requirement for acute accuracy removed, since the integrated zipper system provides a large guiding lateral entrance, automatic alignment and easy-snapin pieces. The ease of which the zipper is used is of great benefit those who need it, and adds an element of fun to those who don't. The vulnerable edges of the elongated coupling elements are reinforced to protect them from fraying and to provide easy alignment of the zipper and to guide the coupling pins into place.

Not only is the present zipper easy-to use from its operational standpoint, but it is even easier since the user does not have to remove their gloves, especially heavy or bulky gloves, such as large ski mittens, firefighter's gloves, loose-fitting gardening gloves, etc-., since the wide aperture of the integrated zipper system is so easily accessible to the user and a closure stroke of the zipper head does the rest. The zipper has the strength of a regular zipper, if not more, in that the socket box in which the pins are held is longer in many embodiments and the intergarment plates protect the initial coupling edges from fraying. Furthermore, the integrated system has the following additional advantages;

- It provides a zipper system that couples and arrests the movement of the members of the female side of the zipper to provide a single female unit for coupling and uncoupling with the male side of the zipper, for either a conventional zipper, one that is coupled from the top, or a laterally coupled zipper, one that is coupled from the side;
- It provides large, easy-to-use, snap-lock lateral coupling, where alignment, immobility, and coupling comes from the design of the zipper system and not the eyesight of the user;
- It makes use of readily available resilient materials, for construction of an economical zipper;
- The zipper provides a very useful large stiffened designated area which is easy to grasp with the fingers or hands, to aid the user to bring the male and female sides readily into the same plane for coupling;
- It provides an integrated zipper with an audible (snap) confirmation that the zipper has been initially coupled, so as to benefit those with sight impairments and to those using the zipper in the dark;
- It enhances the appearance of an article of clothing or article of manufacture by supplying it with a simplistic, adornable, attractive zipper;
- It provides a zipper that needs a minimum of force, pressure or exertion from the user to couple or uncouple the zipper;
- The zipper has a simple operation and is designed for children to easily use by themselves, which is fun for them and gives them the joy of being self-sufficient;
- It can provide a zipper with designs which can educate children in the operation of the zipper;
- It provides an integrated zipper system where most users can readily identify how it operates by looking at its appearance, since a coupling apparatus of the integrated laterally coupled zipper appears and initially works like a two-piece, snaptogether laterally coupled, buckle;
- It makes available an easy-to-use zipper for people who have a hard time starting a zipper, including children, the feeble, those with limited or no vision, those encumbered by the use of gloves, those in a hurry, care givers, and others;
- It promotes feelings of accomplishment and self-reliance, rather than feelings of frustration and dependence.

Although my zipper has been described in terms of particular embodiments and applications, one of ordinary skill in the art, in light of this teaching, can generate additional embodiments and modifications without departing from the spirit of, or exceeding the scope of the claimed zipper system. Examples of this are as follows:

A resilient pin can be inserted through an opening in the front or back of the zipper, achieving the same result as those seen in FIGS. 1A–C. The resilient pin can have a hinged front edge to protect it from repeated use. The resilient pin can have a bendable back edge, which can bend out or into the resilient pin for the same reason, (like a letter that is folded into three equal portions.

Resilient pin 26 or resilient pins 12G–P and 80 through 90 can have different shapes or have different methods of receding within itself or resiliently coupling or may be narrower and tapered at the tips for guiding. The resilient flanges can be cut into smaller flanges that vacillate in up and down positions for coupling. The resilient pins may be slender, curved, or be shaped like a zipper tooth, partial zipper tooth (teeth), or have partial depths (to fit together) with or as conventional zipper teeth. Initial or all zipper teeth can have wider or narrower heads, narrower or wider bases, different shapes, depths, or positioned differently than conventional zipper teeth. Resilient pin 26, 12G–P, or resilient pins 80 through 90 may be at an angle at the end of intergarment plate 52, facilitating its fit next to stationary pins 24–90A within coupling slider 22. Stationary pin 24 can be enlarged, shortened, have zipper teeth, partial teeth, or shaped to work as a socket box. Stationary pin 24 (or pin 26) can have a snap-together, or slide-in, longitudinally released, coupler for instantly coupling pin 24 with pin 26, and box 36 can be eliminated. All interlocking male pins can have horizontal interacting structure such as tongue and groove structure to horizontally align the male pin while sliding into and mating with the coupling slider for coupling.

Non-resilient pin 34 can be put on a rotating axis (kept in original placement by a spring) and retract into intergarment plate 52 so that the zipper can be uncoupled from the top even while using wide non-resilient pin 34. Pin 34 when pulled in an upward motion, pushes against the separating triangle in the upper part of the zipper head. The separating triangle pushes pin 34 down causing it to rotate and fit into a void in intergarment plate 52. A spring behind pin 34 in plate 52 allows pin 34 to retract and restores pin to its original shape. All interlocking pins can horizontal interacting structure (such as tongue and groove) which interacts with the female unit for accurate guiding of the male pin into place for coupling.

If intergarment plates 50 and 52 are angled, the same reason applies. Thumbholds 54 and 56 can be angled for a more comfortable placement of the fingers. Intergarment plates 50 and 52 may be elongated, thickened, have a grooved inset for the sliding of the zipper, or may have different shapes to fit the article of manufacture in which they are used. Plate 52 may have a void to accommodate a retracted male pin. Plate 50 may be eliminated and the user may hold coupling slider 22 instead, to couple the zipper. Snug bump 46 can appear at the bottom edge of member 36 or elsewhere, or eliminated. Box 36 can have other means of temporary adherence. The interlocking male pins not shown with a release mechanism can be supplied with one. The tapered framework of coupling slider 22 can be simplified to appear like the opening edges of a modem interlocking buckle or automobile seat belt buckle entrance with or without a tapering edge. Coupling slider 22 may be thicker or thinner, wider or narrower, or have a lower triangle, depending upon its use. The zipper pull can be considerably wider and hinged in a different location. The zipper teeth can be considerably wider to provide a bigger sliding socket and interlocking male element for a larger zipper on workmens clothes and the like. The outside appearance of coupling slider 22 may be varied, depending upon the article of manufacture, e.g. as on a reversible jacket. The female members may have different methods for arresting the movement of the members for coupling.

This three-way coupled zipper provides a great benefit to very heavy items, such as artificial stadium turf. The turf pieces may be coupled laterally and reliably without pulling the fill heavy length of the turf into a conventional socket. The integrated zipper can be used for joining stiff platelike materials such as room partitions, boxes and lids, and computer and machinery components.

My zipper can be used anywhere a zipper would ordinarily be used or innovativly used, such as toys, magic tricks, packaging materials, plastic sheeting or bags with male and female profile rib and groove closure elements, industrial use, furniture, camping supplies, sports equipment and attire, (including stadium and turf use), luggage, (including back-to-back zippers), automotive, bus, and airline use, home decor, baby and child needs and appliances (lawn mower clipping bags, barbecue covers), other applications, as well as garments (many uses, including attaching hoods to jackets), and other apparel applications.

Accordingly, it is to be understood that the drawings and descriptions are provided by way of example to facilitate comprehension of the zipper system and should not be construed to limit the scope thereof The full scope should be determined only by the appended claims and their legal equivalents.

I claim:

1. A closure system, comprising:

(a) two elongated coupling elements, each having an inner edge and an opposite outer edge, said two elongated coupling elements being affixable to respective lengths of material, said two elongated coupling elements each having a row of interlocking elements mounted on and along said inner edge, said two elongated coupling elements being lockable to each other for coupling and closing and alternately uncoupling and opening said two elongated coupling elements to each other, b) a plurality of movement-arresting members situated on one of said two elongated coupling elements, including a first movement-arresting member slidably connected to said one of said two elongated coupling elements for coupling and uncoupling said two elongated coupling elements along their lengths, c) aligning means for immovably aligning said first movement-arresting member, said aligning means including arresting means for arresting movement of said first movement-arresting member, said arresting means being arranged to arrest horizontal movement of said first movement-arresting member, so as to couple said closure system without movement in said first movement-arresting member and for operating said closure system, and (d) a male interlocking element, situated on the other of said two elongated coupling elements, and arranged to mate with, interlock with, and secure itself to said aligning means, for mating, coupling, and uncoupling said two elongated coupling elements along their length and for operation of said arresting means, whereby said closure system can be coupled instantly from any direction without the hindrance of movement in said first movement-arresting member.

2. The closure system of claim 1, further including means for arresting vertical movement of said first movement-arresting member, said means for arresting vertical movement including means for preventing said first movement member from moving along said one of two elongated coupling elements during coupling, for operation of said closure system.

3. The closure system of claim 1, wherein said arresting means also comprises means for providing a single female unit having a unified, immobile, and aligned socket for instant coupling of said two elongated coupling elements.

4. The closure system of claim 1, further including means for coupling said closure system laterally, so as to operate said closure system.

5. The closure system of claim 1, further including means for coupling said closure system vertically, so as to operate said closure system.

6. The closure system of claim 1, further including an interlocking buckle for affixation to said respective inner edges of said two elongated coupling elements for instantly coupling and uncoupling said two elongated coupling elements, said interlocking buckle comprising (a) a female half-buckle having a plurality of movement-arresting members, comprising, (1) a first movement-arresting member slidably connected to one of said two elongated coupling elements for coupling and uncoupling said two elongated coupling elements and (2) means for arresting movement of said first movement-arresting member so as to provide immobile alignment to said first movement-arresting member for coupling said two elongated coupling elements, and (b) a male half-buckle being adapted for coupling with said female half-buckle so as to operate said closure system, said interlocking buckle having means for audible, instant, snap-lock, lateral, coupling of said two elongated coupling elements, said interlocking buckle also comprising means for allowing said first movement-arresting member to slide and for aligning and coupling said closure system.

7. The closure system of claim 1, further including a resilient locking assembly on one of said two elongated coupling elements, said resilient-locking assembly comprising, (a) a resilient lever, and (b) locking means for coupling and uncoupling said closure system, said resilient locking assembly is adapted to unite with another of said plurality of movement-arresting members, so as to provide a single united immobile socket for coupling, said resilient-locking assembly comprising means for audible snap-lock coupling with said male interlocking element for coupling said two elongated coupling elements.

8. The closure system of claim 1, further including encompassing means on one of said two elongated coupling elements for arresting movement of said first movement-arresting member so as to provide immobile alignment to said first movement-arresting member.

9. The closure system of claim 1, further including automatic aligning means for accurately aligning said first movement-arresting member for instant coupling, said automatic aligning means providing means for forcing said first movement-arresting member all the way down on one of said two elongated coupling elements, if said first movement-arresting member is not all the way down on said one of said two elongated coupling elements for coupling.

10. The closure system of claim 1, further including a resilient male interlocking element, having at least a resilient portion for coupling said said closure system, said resilient male interlocking element having resilient structure and recessing means for entrance into and coupling with said aligning means for locking and unlocking said two elongated coupling elements, said resilient male interlocking element being adapted for audible snap-lock lateral coupling.

11. The closure system of claim 1, further including a plurality of intergarment plates, for affixing to said respective lengths of material for protecting, aligning, accessing and coupling said two elongated coupling elements, said intergarment plates having aligning, coupling, and bracing means so as to operate said closure system, said intergarment plates having holding means for holding said plurality of movement-arresting members, a plurality of fingers and a plurality of connecting bands of material, said intergarment plates having activating and releasing means for disengaging said male interlocking element from said aligning means.

12. The closure system of claim 1, further including a two-way closing system for opening a garment from the bottom up, in order to allow a user access through said closure system, said two-way closing system having a plurality of slidably connected movement-arresting members, including a first movement-arresting member slidably connected to one of said two elongated coupling elements for opening and closing said two elongated coupling elements, said two-way closing system having means for arresting movement of said first movement-arresting member so as to provide immobile alignment to said first movement-arresting member, said two-way closing system is adapted for providing a single, arrested, and immobile socket for said first movement-arresting member, for coupling, and for operation of said two-way closing system.

13. A closure system, comprising:

(a) two elongated coupling elements, each having an inner edge and an opposing outer edge, said two elongated coupling elements being affixable to respective lengths of material, said two elongated coupling elements each having a row of interlocking elements mounted on and along said inner edge, said two elongated coupling elements being lockable to each other for coupling and closing and alternately uncoupling and opening said two elongated coupling elements to each other, (b) a plurality of movement-arresting members, situated on one of said two elongated coupling elements, including a first movement-arresting member slidably connected to said one of said two elongated coupling elements for coupling and uncoupling said two elongated coupling elements along their lengths, said first movement-arresting member being adapted to unite with another of said plurality of movement-arresting members, for providing immobile alignment to said first movement-arresting member, so as to provide a single female unit, said single female unit having a unified, aligned and immobile socket for instant and dependable coupling, and (c) a male interlocking element on the other of said two elongated coupling elements, said male interlocking element being arranged to mate with said unified, aligned and immobile socket, for coupling, and uncoupling said two elongated coupling elements along their length, so as to operate said closure system.

14. The closure system of claim 13, wherein said arresting members comprise immovably aligning structure to arrest horizontal movement of said first movement-arresting member so as to operate said closure system.

15. The closure system of claim 13, further including encompassing means, on one of said two elongated coupling elements, for providing immobile alignment to said first movement-arresting member and for arresting the movement of said first movement-arresting member, so as to operate said closure system.

16. The closure system of claim 13, further including means for coupling said closure system laterally, so as to operate said closure system.

17. The closure system of claim 13, further including means for coupling said closure system vertically, so as to operate said closure system.

18. The closure system of claim 13, further including an interlocking buckle for affixation to said respective inner edges of said two elongated coupling elements for instantly coupling and uncoupling said two elongated coupling elements, said interlocking buckle comprising (a) a female half-buckle having a plurality of movement-arresting members, said female half-buckle further comprising (1) a first movement-arresting member slidably connected to one of said two elongated coupling elements for coupling and uncoupling said two elongated coupling elements along their lengths, and (2) means for arresting movement of said first movement-arresting member and for providing a unified, immobile and aligned socket to said first movement-arresting member for coupling said two elongated coupling elements, and (b) a male half-buckle being adapted for coupling with said female half-buckle so as to operate said closure system, said interlocking buckle having means for instant, audible, snaplock, lateral, coupling of said two elongated coupling elements, said interlocking buckle also comprising means for allowing said first movement-arresting member to slide and for aligning, coupling and operation of said closure system.

19. The closure system of claim 13, further including a resilient-locking assembly on said one of said two elongated coupling elements, said resilient-locking assembly comprising, (a) a resilient lever, and (b) locking means for coupling and uncoupling said closure system, said resilient locking assembly is adapted to unite with another of said plurality of movement-arresting members so as to provide a single, united, immobile, socket for coupling, said resilient-locking assembly comprising means for audible snap-lock coupling with said male interlocking element for coupling said two elongated coupling elements.

20. The closure system of claim 13, further including a two-way closing system for opening a garment from the bottom up, in order to allow a user access through said closure system, said two-way closing system having a plurality of slidably connected movement-arresting members, including a first movement-arresting member slidably connected to one of said two elongated coupling elements for opening and closing said two elongated coupling elements, said two-way closing system having means for arresting movement of said first movement-arresting member so as to provide immobile alignment to said first movement-arresting member.

21. The closure system of claim 13, further including automatic aligning means for accurately aligning said first movement-arresting member for instant coupling, said automatic aligning means providing means for forcing said first movement-arresting member all the way down on one of said two elongated coupling elements, if said first movement-arresting member is not all the way down on said one of said two elongated coupling elements before coupling.

22. A method for operating a closure system, comprising:

(a) providing two elongated coupling elements, each having an inner edge and an opposing outer edge, said two elongated coupling elements being affixable to respective lengths of material, said two elongated coupling elements each having a row of interlocking elements mounted on and along said inner edge, said two elongated coupling elements being lockable to each other for coupling and alternately uncoupling said two elongated coupling elements to each other, (b) providing a plurality of movement-arresting members, situated on one of said two elongated coupling elements, including a first movement-arresting member slidably connected to said one of said two elongated coupling elements for coupling and uncoupling said two elongated coupling elements along their lengths, said plurality of movement-arresting members being adapted for providing immobile alignment to said first movement-arresting member, said plurality of movement-arresting members being adapted to arrest the movement of said first movement-arresting member, so as to arrest horizontal movement of said first movement-arresting member, for operation of said closure system, (c) providing a male interlocking element on the other of said two elongated coupling elements, said male interlocking element being arranged to couple with, mate with, and secure itself to said immobile alignment, for coupling and closing and alternately uncoupling and opening said two elongated coupling elements and for operation of said closure system, (d) pulling said first movement-arresting member in a first direction along said one of said two elongated coupling elements to one end thereof, (e) providing immobile aligning to said first movement-arresting member and arresting horizontal movement of said first movement-arresting member, (f) pressing said male interlocking element into said immobile alignment, coupling said closure system, (g) pulling said first movement-arresting member in a second direction, opposite to said first direction, (h) locking said two elongated coupling elements along their length, (i) pulling said first movement-arresting member in said first direction to one end thereof, (j) unlocking said two elongated coupling elements, and (k) uncoupling said closure system.

23. The method of operating a closure system of claim 22, further including encompassing means for providing immobile alignment to said first movement-arresting member, said encompassing means arranged to provide a unified, immobile, and aligned socket for said first movement-arresting member for instantly coupling said two elongated coupling elements so as to operate said closure system.

* * * * *